US009744588B2

(12) United States Patent
Oda et al.

(10) Patent No.: US 9,744,588 B2
(45) Date of Patent: Aug. 29, 2017

(54) MELTING FURNACE FOR PRODUCING METAL

(75) Inventors: Takashi Oda, Chigasaki (JP); Hisamune Tanaka, Chigasaki (JP); Takeshi Shiraki, Chigasaki (JP); Norio Yamamoto, Chigasaki (JP)

(73) Assignee: TOHO TITANIUM CO., LTD., Chigasaki-Shi, Kanagawa (JP)

( * ) Notice: Subject to any disclaimer, the term of this patent is extended or adjusted under 35 U.S.C. 154(b) by 0 days.

(21) Appl. No.: 14/000,223

(22) PCT Filed: Feb. 27, 2012

(86) PCT No.: PCT/JP2012/054835

§ 371 (c)(1),
(2), (4) Date: Aug. 19, 2013

(87) PCT Pub. No.: WO2012/115272

PCT Pub. Date: Aug. 30, 2012

(65) Prior Publication Data

US 2013/0327493 A1 Dec. 12, 2013

(30) Foreign Application Priority Data

Feb. 25, 2011 (JP) ..... 2011-040861
Apr. 27, 2011 (JP) ..... 2011-099402
Apr. 27, 2011 (JP) ..... 2011-099408

(51) Int. Cl.
*B22D 7/06* (2006.01)
*B22D 11/124* (2006.01)
(Continued)

(52) U.S. Cl.
CPC ..... *B22D 7/06* (2013.01); *B22D 11/001* (2013.01); *B22D 11/0403* (2013.01);
(Continued)

(58) Field of Classification Search
CPC . B22D 7/00; B22D 7/06; B22D 7/064; B22D 7/08; B22D 9/00; B22D 9/003; B22D 11/16; B22D 11/22; B22D 11/225
(Continued)

(56) References Cited

U.S. PATENT DOCUMENTS 3,834,447 A 9/1974 Luchok et al.
4,665,969 A * 5/1987 Horst et al. ..... 164/439
(Continued)

FOREIGN PATENT DOCUMENTS

EP 0656238 A2 6/1995
GB 1112017 5/1968
(Continued)

OTHER PUBLICATIONS

European Search Report in corresponding EP 12750217.7 dated Jun. 1, 2016.

*Primary Examiner* — Kevin P Kerns
*Assistant Examiner* — Steven Ha
(74) *Attorney, Agent, or Firm* — Fitch, Even, Tabin & Flannery, LLP

(57) ABSTRACT

In production of a reactive metal using a melting furnace for producing metal having a hearth, ingots can be efficiently produced by efficiently cooling the ingots extracted from the mold provided in the melting furnace. In addition, an apparatus structure in which multiple ingots can be produced with high efficiency and high quality from one hearth, is provided. A melting furnace for producing metal is provided, the furnace has a hearth for having molten metal formed by melting raw material, a mold in which the molten metal is poured, an extracting jig which is provided below the mold for extracting ingot cooled and solidified downwardly, a cooling member for cooling the ingot extracted downwardly of the mold, and an outer case for keeping the hearth, the
(Continued)

mold, the extracting jig, and the cooling member separated from the air, wherein at least one mold and extracting jig are provided in the outer case, and the cooling member is provided between the outer case and the ingot, or between the multiple ingots.

6 Claims, 18 Drawing Sheets

(51) Int. Cl.

| | |
|---|---|
| ***F27B 7/00*** | (2006.01) |
| ***F27D 3/14*** | (2006.01) |
| ***B22D 47/00*** | (2006.01) |
| ***F27B 19/04*** | (2006.01) |
| ***B22D 11/00*** | (2006.01) |
| ***B22D 11/04*** | (2006.01) |
| ***B22D 11/055*** | (2006.01) |
| ***B22D 11/14*** | (2006.01) |
| ***B22D 41/015*** | (2006.01) |

(52) U.S. Cl.
CPC ..... *B22D 11/0406* (2013.01); *B22D 11/055* (2013.01); *B22D 11/124* (2013.01); *B22D 11/1243* (2013.01); *B22D 11/141* (2013.01); *B22D 11/147* (2013.01); *B22D 41/015* (2013.01); *B22D 47/00* (2013.01); *F27B 7/00* (2013.01); *F27B 19/04* (2013.01); *F27D 3/14* (2013.01)

(58) Field of Classification Search
USPC ..... 164/420, 443, 444, 250.1, 505–515
See application file for complete search history.

(56) References Cited

U.S. PATENT DOCUMENTS

| | | | | |
|---|---|---|---|---|
| 6,474,401 | B1 * | 11/2002 | Streubel | 164/418 |
| 2007/0006989 | A1 * | 1/2007 | Jackson et al. | 164/469 |
| 2008/0035298 | A1 * | 2/2008 | Yu et al. | 164/455 |
| 2013/0327493 | A1 | 12/2013 | Oda et al. | |

FOREIGN PATENT DOCUMENTS

| | | | |
|---|---|---|---|
| JP | 62-130755 | | 6/1987 |
| JP | 63-112043 | | 5/1988 |
| JP | 63-165047 | | 7/1988 |
| JP | 63-184663 | | 11/1988 |
| JP | 3-99752 | | 4/1991 |
| JP | 3-75616 | | 12/1991 |
| JP | 9-38751 | | 2/1997 |
| JP | 9-99344 | | 4/1997 |
| JP | 10-29046 | | 2/1998 |
| JP | 10-58093 | | 3/1998 |
| JP | 10-180418 | | 7/1998 |
| JP | 11207442 | | 3/1999 |
| JP | 2012177522 | A | 9/2012 |
| WO | 2012115272 | A1 | 8/2012 |

* cited by examiner

MELTING FURNACE FOR PRODUCING METAL

TECHNICAL FIELD

The present invention relates to a melting furnace for producing metal such as titanium, and in particular, relates to a structure of the melting furnace that can improve production efficiency of metal ingots.

BACKGROUND ART

The amount of titanium metal produced has been greatly increased due to a recent feature of demand increase in the world not only in the aircraft industry, but also in the other fields. Demand for titanium sponge and titanium metal ingots have been greatly increased due to the increase of the titanium metal production.

The titanium metal ingots are produced in a vacuum arc remelting furnace by melting the titanium sponge briquette, which briquettes are formed of compacting titanium sponges produced by the Kroll Process in which titanium tetrachloride is reduced by such a reducing metal as magnesium.

The following process is also known as another process for producing titanium metal ingots, in which titanium metal scrap is mixed with titanium sponge to prepare raw material for melting, the raw material being melted by an electron beam melting furnace or a plasma melting furnace. An example of this electron beam melting furnace is shown in FIGS. 1 to 3 (FIG. 2 is a plane view of FIG. 1 seen from direction A, and FIG. 3 is a cross-sectional view taken along line B-B).

The raw material is not necessarily formed into the electrode in this electron beam melting furnace, which is different from the vacuum arc melting furnace and a granular or agglomerated raw material 12 can be fed into a melting hearth 13.

Since molten metal 20 generated by melting the raw material 12 in the hearth 13 is flowed from the hearth 13 into a mold 16, impurities in the molten metal can be removed by the vaporization of impurities in the raw material, therefore a highly pure titanium metal ingot can be produced n the electron beam melting furnace.

In this way, the electron beam melting furnace with a hearth can produce a highly pure ingot metal not only in case of titanium metal, but also in case of such a refractory metal as zirconium, hafnium or tantalum containing impurities therein.

The ingot 22 cooled and solidified in the mold 16 mentioned above is extracted by an extracting jig 30 in the electron beam melting furnace. Since the ingot 22 just after extracted from the mold 16 is kept at high temperature and the inside of extracting zone 50 is at reduced pressure, it is difficult to directly cool the ingot like a water spray cooling in a continuous casting of steel (see Japanese Unexamined Patent Application Publication No. Hei 10 (1998)-180418. From a practical perspective, as shown by wavy arrows in FIGS. 1 and 3, when the ingot 22 is cooled only by radiation of heat, it may take a very long time until the ingot temperature reaches a room temperature. As is explained, since cooling of the ingot in the extracting area 50 takes a long time, a efficient cooling apparatus of the ingot produced in the mold 16 has been desired.

As another method to improve the productivity of the melting furnace for producing metal, a technique is known in which molten metal generated by melting an electrode in one retort is poured into multiple molds which can produce simultaneously multiple ingots (see U.S. Pat. No. 3,834,447).

Furthermore, in order to improve productivity of an ingot, an electron beam melting furnace is proposed, in which molds 16 are provided, molten metal is divided by a ladle 17 to produce multiple ingots at the same time as shown in FIGS. 4 to 7 (FIG. 5 is a plane view of FIG. 4 seen from direction A, FIG. 6 is a side view of FIG. 4 seen from direction C, and FIG. 7 is a cross-sectional view taken along line B-B) (see Japanese Patent Application Laid Open No. Hei03 (1991)-75616).

As mentioned above, Ingots 22 also is cooled merely by a radiation, and thus cooling efficiency is quite low in the electron beam melting furnace. Furthermore, as shown in FIGS. 6 and 7, the heat content of the ingot is removed appropriately by a radiation from the ingot surface to the outer case 51 in the extracting zone; however, the extent of the heat radiation is decreased in case that the ingot surface is mutually faced each other (near the central area in the extracting area 50), and as a result, the cooling rate of the ingot is decreased.

Furthermore, non-uniform temperature distribution in an ingot may cause deformation of the ingot such as warping or curving. Thus these problems should be solved.

A so-called "solidified shell" like a skin solid is formed on the mold inner surface contacting the molten metal in the mold pool. The thickness of the solidified shell has a tendency of the increase toward the bottom part of the mold pool and then the mold pool region is decreased and only the solid ingot is remained in the lower portion of the mold. This is because the amount of heat loss toward the bottom of the mold is increased in addition to the amount of the heat loss to the mold side wall.

An interface boundary between the mold pool and the solidified shell often figures a parabolic line on a cross sectional area along a vertical direction as shown by reference numeral 21*b* in FIG. 31A. The thickness of the solidified shell formed on an inner wall surface of the mold has a tendency to increase toward vertically the lower direction of the mold pool. This results in decreasing the mold pool region, decreasing stirring effect of molten salts by convection in the mold pool, and undesirably segregating alloy components. Therefore, as shown in FIG. 31B, it is preferable for the interface to have a parabolic shape in which a bottom parabolic line is swelled toward both sides. It is known that it is preferable that the thickness of a solidifying shell formed on the inner wall surface of the mold from the top of the mold pool to the bottom of mold pool (meniscus portion, 21*a*) be as constant as possible in order to maintain the casting surface of the ingot produced good condition.

As explained so far, in an electron beam melting furnace for titanium metal, an apparatus of the electron beam melting furnace having a mold in which thickness of a shell formed on an inner wall surface contacting the mold pool is kept as thin as possible, the meniscus portion is kept long, and the bottom part of the mold pool is formed wide, is desired.

SUMMARY OF THE INVENTION

The above-mentioned problems are also common to the plasma arc melting furnaces, and thus a melting furnace for the metal that can solve these problems is desired.

An object of the present invention is to provide an apparatus of the melting furnace for the metal, in which multiple ingots can be efficiently produced with high quality in the production of active metal using a melting furnace for melting metal having a hearth, in particular, an electron beam melting furnace or plasma arc melting furnace.

As a result of researching the solution for the above mentioned problems, the inventors have found that in the melting furnace for the metal for producing an ingot, having a hearth for melting raw material, a mold, an extracting jig for the ingot, and an outer case, ingots can be efficiently produced by arranging a cooling member between the ingot produced and the outer case, and thus the invention has been completed.

In addition, the inventor also found that an ingot produced in the mold can be efficiently cooled by forming temperature distribution along a vertical direction in the cooling member.

Furthermore, the inventor also found that the surface of ingot produced can be maintained in superior condition by forming the temperature distribution in the mold for producing the ingot, in which temperature monotonically decreases from the mold top portion to the bottom portion, and by forming at least one inflection point of temperature distribution.

That is, a melting furnace for producing metal of the present invention has a hearth for holding molten metal formed by melting raw material, a mold in which the molten metal is poured, an extracting jig which is provided below the mold for extracting ingot cooled and solidified downwardly, a cooling member for cooling the ingot extracted downwardly of the mold, and an outer case for keeping the hearth, the mold, the extracting jig, and the cooling member separate from the air, wherein the cooling member is provided between the outer case and the ingot.

In the present invention, it is preferable that the cooling member extend along the extracting direction of the ingot with a certain gap from the ingot surface.

In the present invention, it is preferable that the cooling member surround the complete circumference or partial circumference of the ingot, viewed along a cross section vertical to the extracting direction of the ingot.

In the present invention, it is preferable that the cooling member consist of a water cooling jacket or a water cooling coil.

In the present invention, it is preferable that the mold be provided multiply and that the cooling member be provided between ingots extracted from the multiple molds.

In the present invention, it is preferable that a mold having an open bottom be provided in the melting furnace, that the mold wall have a temperature distribution in which temperature monotonically decreases from the top part to the bottom part, and that there be at least one inflection point in the temperature distribution.

In the present invention, it is preferable that the mold consist of a primary cooling portion which is an upper part of the mold and a secondary cooling portion which is a lower part of the mold, the primary cooling portion is a thickness increasing portion in which thickness of the mold wall is increased in the upper direction of the wall, and the secondary cooling portion is a parallel portion in which thickness of the mold wall is constant.

In the present invention, it is preferable that a cooling medium flowing in the mold consist of a primary cooling medium supplied to the primary cooling portion and a secondary cooling medium supplied to the secondary cooling portion, and temperature of the primary cooling medium be higher than the secondary cooling medium.

In the present invention, it is preferable that the cooling medium flowing in the mold be serially supplied to the primary cooling portion and the secondary cooling portion, that the cooling medium be flowing continuously through a cooling coil wound around the primary cooling portion and the secondary cooling portion, and that the cooling coil be wound relatively sparsely around the primary cooling portion and be wound relatively densely around the secondary cooling portion.

In the present invention, it is preferable that the cooling medium flowing to the mold consist of a primary cooling medium cooling the primary cooling portion and a secondary cooling medium cooling the secondary cooling portion, that they be separately supplied in parallel, that the primary cooling medium be flowing in a coil wound around the primary cooling portion, and that the secondary cooling medium be flowing in a coil wound around the secondary cooling portion.

In the present invention, it is preferable that a taper portion be formed at a lower part of the secondary cooling portion, in which a diameter of the inner surface of the mold is decreased along the extracting direction of the ingot.

In the present invention, it is preferable that the melting furnace for melting metal be an electron beam melting furnace or a plasma arc melting furnace.

By using the melting furnace for melting metal of the present invention, the ingot extracted can be efficiently cooled, thereby improving production efficiency of the ingot.

Furthermore, in a case in which multiple ingots are extracted at the same time, not only can the cooling rate of the ingots be improved by promoting heat radiation between ingots that are facing each other, but also, formation of nonuniform temperature distribution in one ingot can be reduced. Therefore, thermal deformation of the ingot can also be avoided, and as a result, an ingot having superior linear properties without warping and having superior casting surfaces, can be produced.

Furthermore, by using the melting furnace for melting metal of the present invention, since the mold pool in which a meniscus portion is long and a bottom part of the mold pool is wide, is formed, not only is the casting surface of the ingot superior, but also the macro structure of the ingot is superior.

BRIEF EXPLANATION OF DRAWINGS

FIG. 8 is a conceptual view showing one Embodiment of the present invention.

FIG. 9 is a conceptual view showing one Embodiment of the present invention.

FIG. 10 is a conceptual view showing one Embodiment of the present invention.

FIG. 11 is a conceptual view showing one Embodiment of the present invention.

FIG. 12 is a conceptual view showing one Embodiment of the present invention.

FIG. 13 is a conceptual view showing one Embodiment of the present invention.

FIG. 14 is a conceptual view showing one Embodiment of the present invention.

FIG. 15 is a conceptual view showing one Embodiment of the present invention.

FIG. 22 is a conceptual diagram showing one Embodiment of the present invention.

FIG. 23 shows an electron beam melting furnace of one Embodiment of the present invention.

FIG. 24 shows an electron beam melting furnace of one Embodiment of the present invention.

FIG. 25 shows an electron beam melting furnace of one Embodiment of the present invention.

BEST MODE FOR CARRYING OUT THE INVENTION

The best mode of the present invention is explained in detail as follows by way of example of a case in which the melting furnace for melting metal is an electron beam melting furnace, with reference to the drawings. In the following explanation, a case in which the raw material is titanium sponge, the ingot to be produced is of titanium metal, and a cross section of the ingot produced is square, is exemplified; however, the electron beam melting furnace of the present invention is not limited to the production of titanium ingots, and the present invention can also be employed for a high-melting point metal such as zirconium, hafnium, tungsten or tantalum, other metals which can be produced in ingots by an electron beam melting furnace, or alloys of these metals. In addition, regarding the cross section, the present invention is not limited to a rectangle, and the present invention can be employed for any other cross sectional shape such as a circle, ellipse, barrel, polygon, or other irregular shapes.

First Embodiment (Single Ingot+Tabular Cooling Member)

Figure 1:
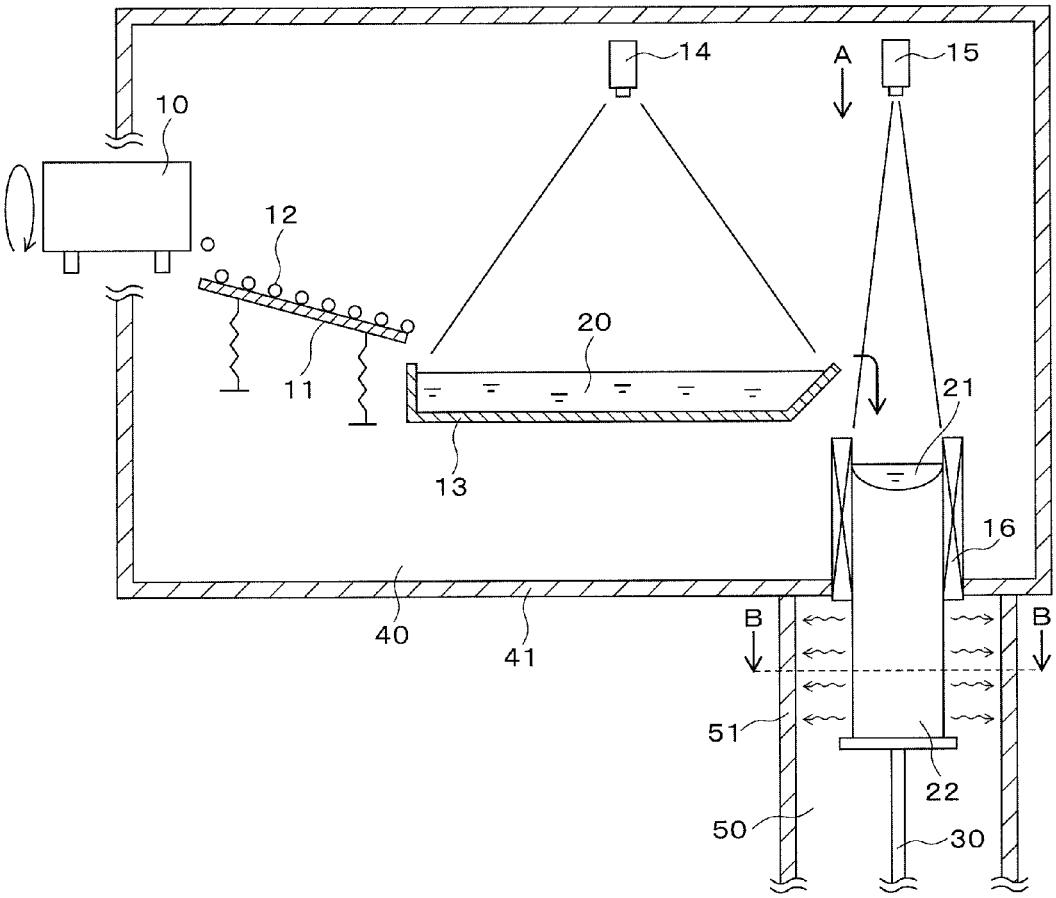
FIG. 1 is a conceptual cross sectional view showing common construction elements of an electron beam melting furnace for producing a single ingot, in a conventional technique and in the present invention.
Figure 2:
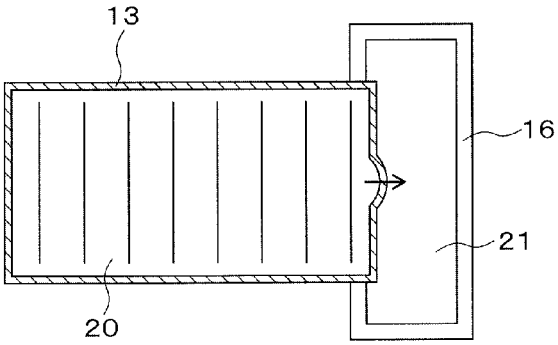
FIG. 2 is a plane view of FIG. 1 seen from the direction A.
Figure 3:
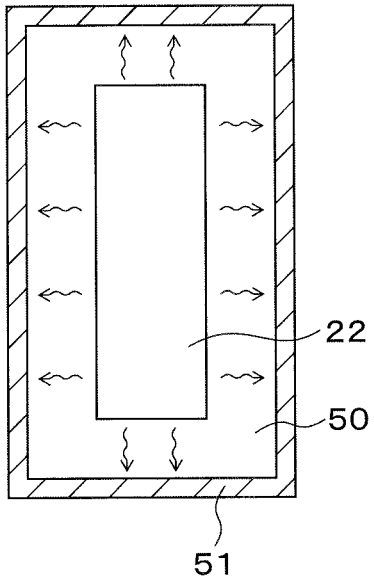
FIG. 3 is a cross sectional view of FIG. 1 taken along line B-B.
Figure 4:
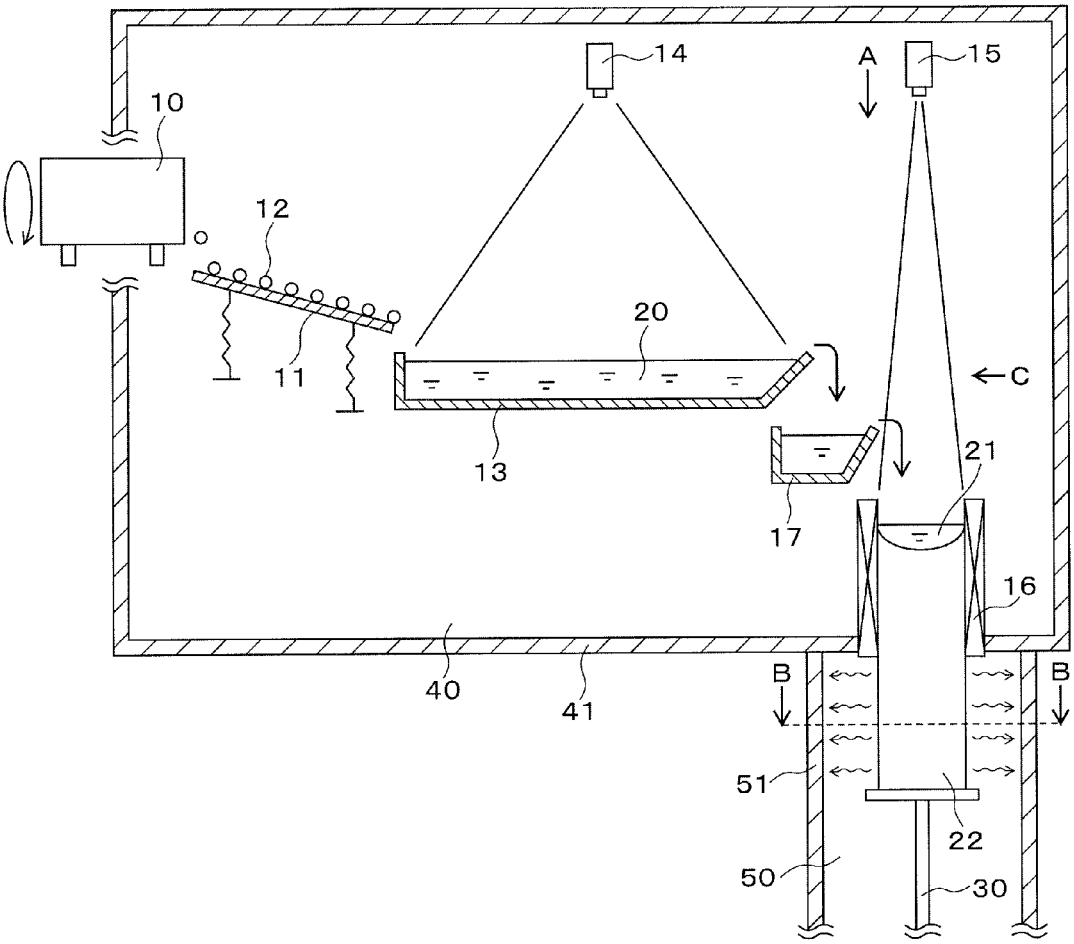
FIG. 4 is a conceptual cross sectional view showing common construction elements of an electron beam melting furnace for producing multiple ingots, in a conventional technique and in the present invention.

FIGS. 1 to 3 show common construction elements of an electron beam melting furnace for producing a single ingot, in a conventional technique and in the present invention. FIG. 2 is a plane view of FIG. 1 seen from the direction A, and FIG. 3 is a cross sectional view of FIG. 1 taken along line B-B. The electron beam melting furnace shown in FIG. 1 consists of a melting area 40 in which raw material is melted, and an extracting area 50 in which an ingot that has been produced is extracted, provided at a lower part of the melting area 40.

In the melting area 40 which is divided by melting area wall 41, a raw material supplying device 10 such as Archimedes can or the like for supplying titanium raw material 12 consisting of titanium sponge or titanium scrap, a raw material conveying device 11 such as a vibrating feeder or the like for conveying the raw material 12, a hearth 13 for melting the raw material supplied, an electron beam radiating device 14 for melting the raw material 12 supplied in the hearth 13 to form molten metal 20, a mold 16 consisting of water cooled copper or the like for forming an ingot by cooling and solidifying the molten metal 20, and an electron beam radiating device 15 for forming molten metal pool 21 by radiating electron beam inside the mold 16, are provided.

At a lower area of the mold 16 of the melting area 40, the extracting area 50 that is divided by an extracting area outer case 51 is provided. Inside of the extracting area 50, an extracting jig 30 for extracting ingot 22 produced in the mold 16 downwardly is arranged. It should be noted that the melting area 40 and the extracting area 50 are constructed so that reduced pressured is maintained.

First, the raw material 12 supplied from the raw material supplying device 10 is melted in the hearth 13 by the electron beam radiating device 14 to form the molten metal 20. The molten metal 20 is supplied from downstream of the hearth 13 to inside of the mold 16. A stub (not shown) is provided in the mold 16 before melting of the raw material 12, this stub functions as the bottom part of the mold 16. The stub is made of as same metal as the raw material 12, and it is unified with the molten metal 20 supplied in the mold 16 to form the ingot 22.

The surface of the molten metal 20 continuously supplied on the stub in the mold 16 is heated by the electron beam radiating device 15 to keep molten metal pool 21, and the bottom of the molten metal pool 21 is cooled and solidified by the mold 16 and is unified with the stub so as to form the ingot 22.

The ingot 22 formed in the mold 16 is extracted at the extracting area 50 with control of the extracting rate of the extracting jig 30 engaged to the stub so that the level of the molten metal pool 21 is maintained at a constant level.

The above explanation is for the common construction and action of the electron beam melting furnace for producing a single ingot of the conventional technique and in the present invention, in addition, in the first embodiment of the present invention, as shown in FIG. 8, a tabular cooling member 60 is provided in the extracting area 50.

Figure 8A:
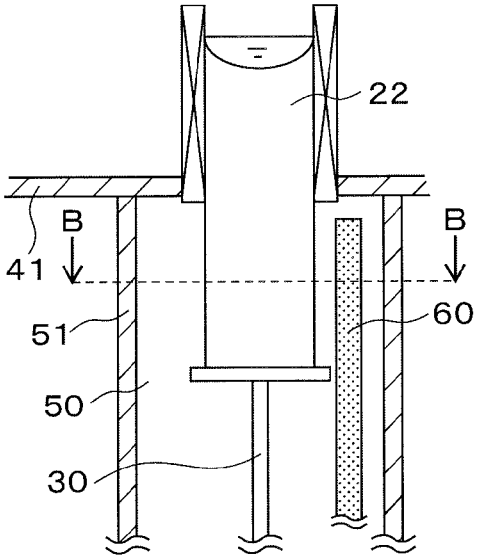
FIG. 8A is a cross sectional side view of the ingot extracting area.
Figure 8B:
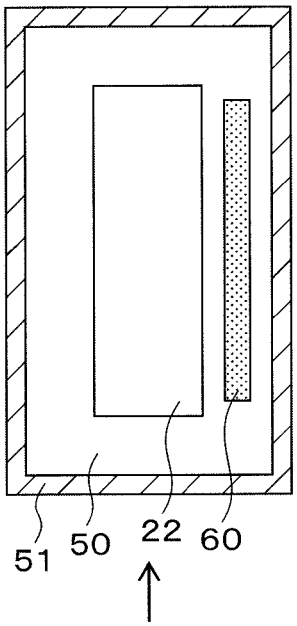
FIG. 8B is a cross sectional view of FIG. 8A taken along line B-B.

FIG. 8A is a cross sectional side view of the ingot extracting area 50, and FIG. 8B is a cross sectional view of FIG. 8A taken along line B-B. As shown in FIG. 8, the tabular cooling member 60 is provided so as to extend along the surface of the ingot 22 while keeping a certain distance to the surface, at one side of the ingot 22 extracted and the extracting jig 30. The cooling member 60 is not limited in particular, as long as it can be cooled by flowing cooling medium therein from the outside; for example, a water cooled copper jacket may be mentioned.

As shown in FIG. 3, since the inside of the extracting area 50 is held at reduced pressure in the conventional electron beam melting furnace, the ingot is cooled by primarily by radiation to the extracting area outer case 51 of the electron beam melting furnace. However, in the first embodiment of the present invention, since the tabular cooling member 60 is provided between the ingot and the body of the electron beam melting furnace in the extracting area 50, heat radiation distance is shortened and heat radiation amount is increased, thereby promoting cooling of the ingot 22. As a result, extracting rate of the ingot produced can be increased. Improvement of cooling rate of the ingot means that the melting rate can be increased, and as a result, production rate of the ingot can be increased.

Second Embodiment (Single Ingot+Square Bracket Shaped Cooling Member)

Figure 9A:
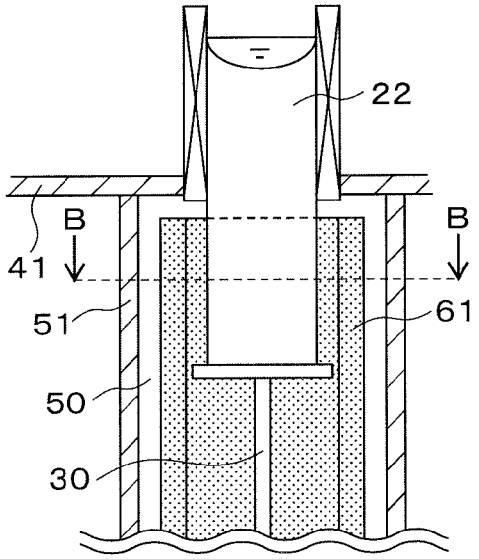
FIG. 9A is a cross sectional side view of the ingot extracting area.
Figure 9B:
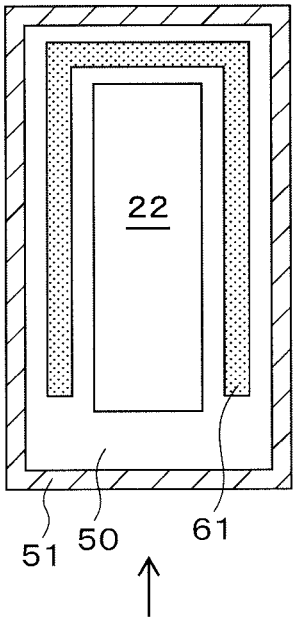
FIG. 9B is a cross sectional view of FIG. 9A taken along line B-B.

In the second embodiment of the present invention, as shown in FIG. 9, a cooling member having cross section of a square bracket shape "]" is provided in the extracting area 50. FIG. 9A is a cross sectional side view of the extracting area 50, and FIG. 9B is a cross sectional view of FIG. 9A taken along line B-B.)

As shown in FIG. 9, at three sides of the ingot 22 extracted and the extracting jig 30, the cooling member 61 having cross section of extracting direction of the square bracket is provided so as to extend along the three side surfaces of the ingot 22 while maintaining a certain distance to the surfaces.

By the second embodiment of the present invention, since the cooling member 61 having a cross section of a square bracket shape is provided in the extracting area 50, heat radiation of the ingot 22 can be promoted more than in the case of the first embodiment, thus cooling can be performed faster.

Third Embodiment (Single Ingot+Square Shaped Cooling Member)

Figure 10A:
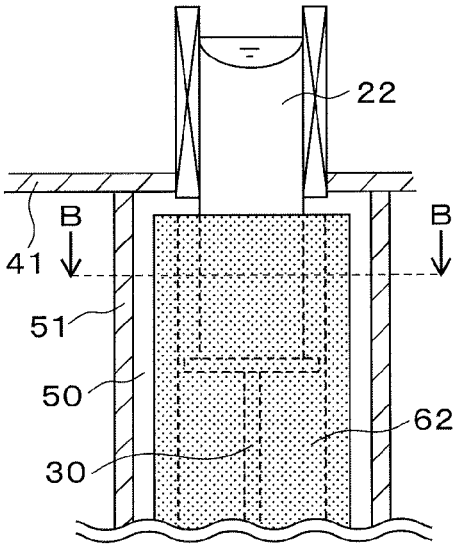
FIG. 10A is a cross sectional side view of the ingot extracting area.
Figure 10B:
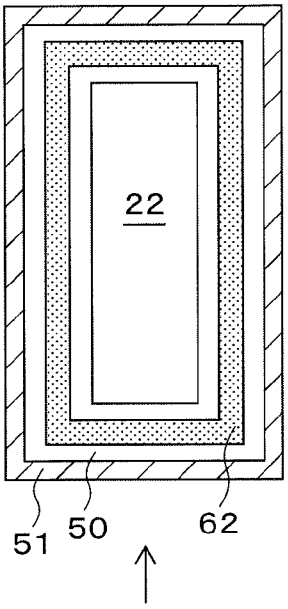
FIG. 10B is a cross sectional view of FIG. 10A taken along line B-B.

In the third embodiment of the present invention, as shown in FIG. 10, a cooling member having cross section of a square shape is provided in the extracting area 50. FIG. 10A is a cross sectional side view of the ingot extracting area 50, and FIG. 10B is a cross sectional view of FIG. 10A taken along line B-B.

As shown in FIG. 10, at four sides of the ingot 22 extracted and the extracting jig 30, the cooling member 62 having cross section of extracting direction of a square shape is provided so as to extend along the four side surfaces of the ingot 22 while maintaining a certain distance to the surfaces.

By the third embodiment of the present invention, since the cooling member 62 having a cross section of a square shape is provided in the extracting area 50, the ingot can be cooled from all the directions, heat radiation of the ingot 22 can be promoted more than in the case of the first and second embodiments, and thus cooling can be performed faster.

Fourth Embodiment (Single Ingot+Coil Shape Cooling Member)

Figure 11A:
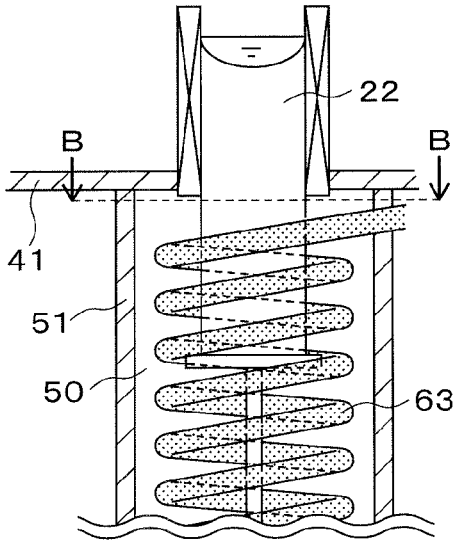
FIG. 11A is a cross sectional side view of the ingot extracting area.
Figure 11B:
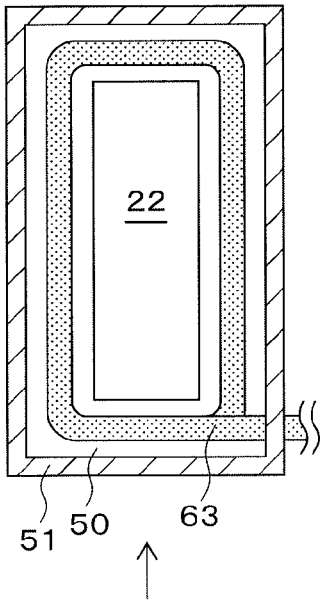
FIG. 11B is a cross sectional view of FIG. 11A taken along line B-B.

In the fourth embodiment of the present invention, as shown in FIG. 11, a cooling member consisting of a spiral coil is provided in the extracting area 50. FIG. 11A is a cross sectional side view of the ingot extracting area 50, and FIG. 11B is a cross sectional view of FIG. 11A taken along line B-B.

As shown in FIG. 11, the cooling member 63 having a spiral coil shape is surrounding the four sides of the ingot 22 extracted and the extracting jig 30 so as to extend along the four side surfaces of the ingot 22 while maintaining a certain distance to the surfaces. As such a cooling member 63, it is not limited in particular as long as it consists of a tube member through which cooling medium can be made to flow from the outside, and for example, a water cooled copper coil may be mentioned.

By the fourth embodiment of the present invention, since the cooling member 63 having a coil shape is provided in the extracting area 50, the ingot can be cooled from all the directions, heat radiation of the ingot 22 can be promoted in the same manner as in the third embodiment, and thus cooling can be performed faster.

Fifth Embodiment (Multiple Ingots+Tabular Cooling Member)

Figure 5:
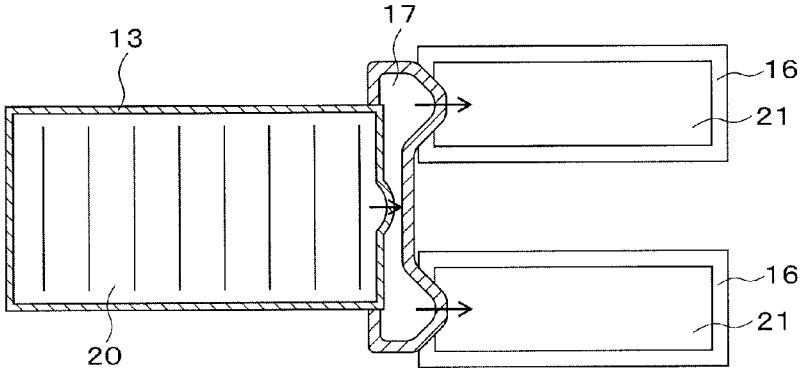
FIG. 5 is a plane view of FIG. 4 seen from the direction A.
Figure 6:
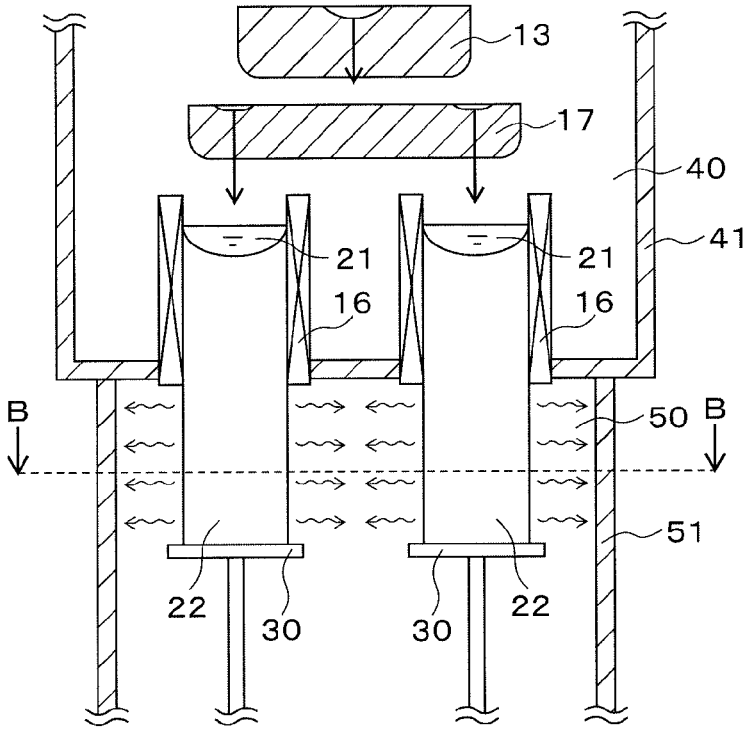
FIG. 6 is a side view of FIG. 4 seen from the direction C.
Figure 7:
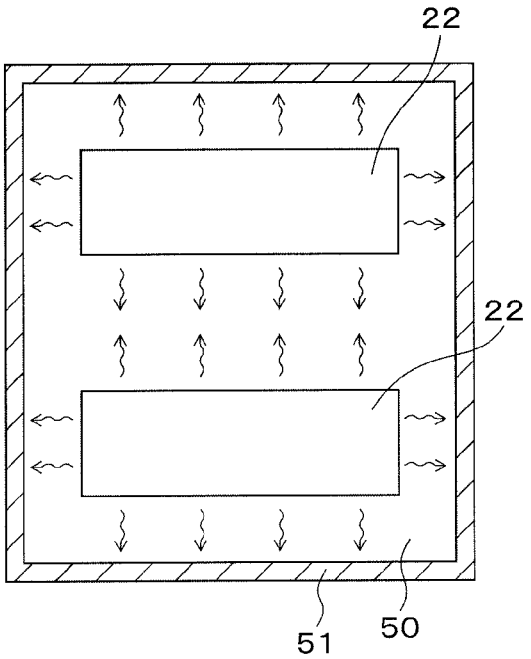
FIG. 7 is a cross sectional view of FIG. 4 taken along line B-B.

FIGS. 4 to 7 show common construction elements of an electron beam melting furnace for producing multiple ingots, in a conventional technique and in the present invention. FIG. 5 is a plane view of FIG. 4 seen from the direction A, FIG. 6 is a side view of FIG. 4 seen from the direction C, and FIG. 7 is a cross sectional view of FIG. 4 taken along line B-B. Among the construction elements of electron beam melting furnace shown in FIG. 4, explanations of a raw material supplying device 10, raw material conveying device 11, hearth 13, and electron beam radiating devices 14 and 15 are omitted since they are common to those of the electron beam melting furnace shown in FIG. 1.

In the electron beam melting furnace shown in FIGS. 4 to 7, two molds 16 are provided in parallel so that their edges of longitudinal direction are parallel. In addition, a sluice 17 that at one time holds molten metal 20 and divides it into each of the multiple molds 16, is provided between the hearth 13 and the molds 16. In the extracting area 50 provided at a lower area of the melting area 40, an extracting jig 30 is provided for each of the multiple molds 16, thereby enabling extracting ingots 22 formed in the multiple molds 16.

The above explanation is for the common construction and action of the electron beam melting furnace for producing multiple ingots of conventional technique and the present invention, and in addition, in the fifth embodiment of the present invention, as shown in FIG. 12, a tabular cooling member 60 is provided in the extracting area 50.

Figure 12A:
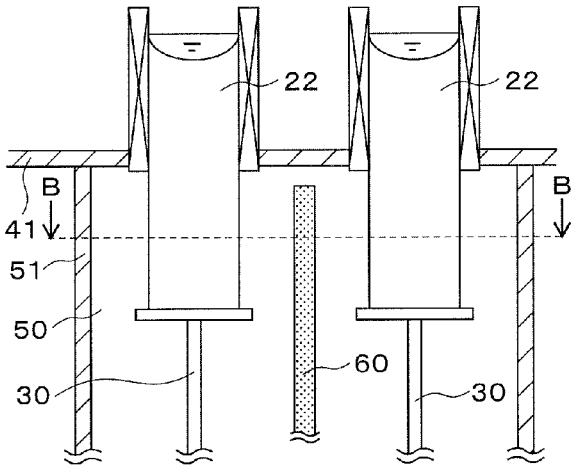
FIG. 12A is a cross sectional side view of the ingot extracting area.
Figure 12B:
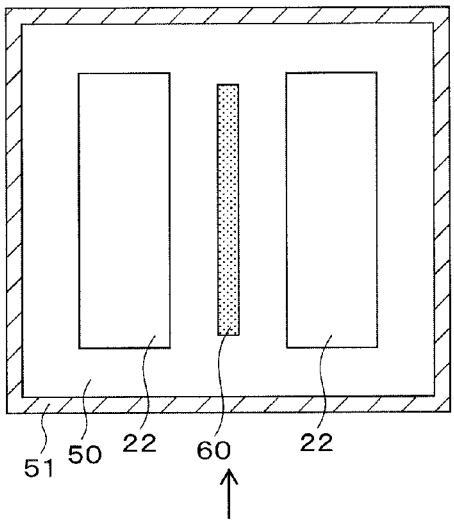
FIG. 12B is a cross sectional view of FIG. 12A taken along line B-B.

FIG. 12A is a cross sectional side view of the extracting area 50, and FIG. 12B is a cross sectional view of FIG. 12A taken along line B-B. As shown in FIG. 12, in a space between the ingots 22 extracted and between the extracting jigs 30, the tabular cooling member 60 is provided so as to extend along the surface of each of the ingots 22 while maintaining a certain distance to each surface.

As shown in FIG. 7, since the inside of the extracting area 50 is maintained at reduced pressure in the conventional electron beam melting furnace, the ingots 22 cannot be cooled by supplying directly cooling medium and the ingots 22 are cooled primarily by radiation, as indicated by wavy arrows. The surface of ingots 22 that face to the extracting area outer case 51 can radiate heat, thereby promoting cooling; however, in a vicinity of a central area where two ingots 22 face each other, since they receive radiation heat from each other, the cooling rate of ingots 22 is decreased, thereby bringing worsening the production rate. In addition, at the central area, since cooling is not promoted compared to a circumferential area of the ingots 22 facing each other, nonuniform temperature distribution is generated in one ingot depending on the position of its surface, thereby causing deformation of an ingot, such as warping.

However, in the fifth embodiment of the present invention, since the tabular cooling member 60 is provided between the ingots 22, heat radiation is also promoted on the surfaces where the ingots mutually face, thereby enabling rapid cooling. As a result, uniform cooling can be performed on all of the surfaces of the ingots.

In the above explanation of the fifth embodiment, the example in which ingots are produced in two lines is explained; however, the present embodiment is not limited to the production of ingots in two lines, and for example, production of ingots in three or more lines is possible. In that case, the ingot 22 and the cooling member 60 are provided alternately.

Sixth Embodiment (Multiple Ingots+Square Bracket Shaped Cooling Member)

Figure 13A:
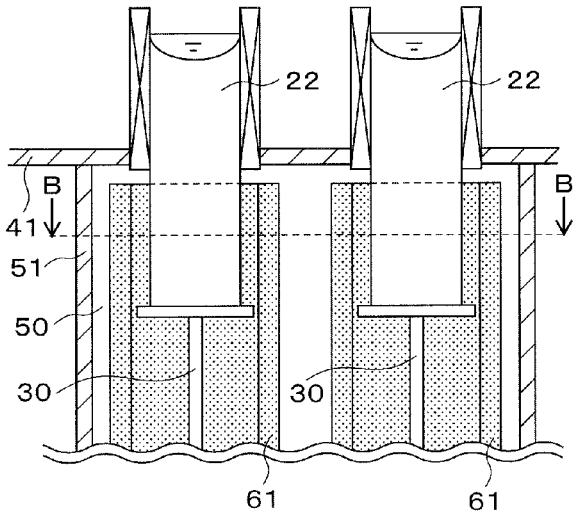
FIG. 13A is a cross sectional side view of the ingot extracting area.
Figure 13B:
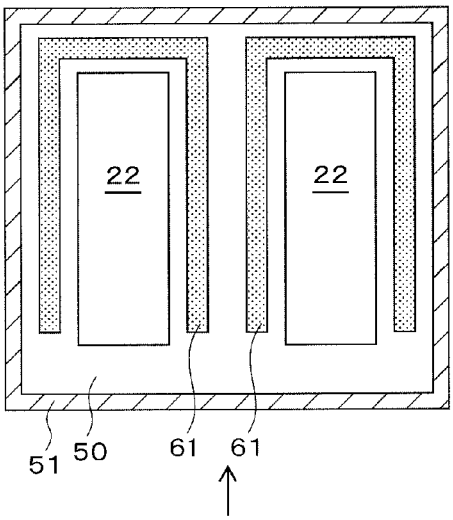
FIG. 13B is a cross sectional view of FIG. 13A taken along line B-B.

In the sixth embodiment of the present invention, as shown in FIG. 13, a cooling member having cross section of a square bracket "]" is provided in the extracting area 50. FIG. 13A is a cross sectional side view of the extracting area 50, and FIG. 13B is a cross sectional view of FIG. 13A taken along line B-B.

As shown in FIG. 13, at three sides of each combination of the ingot 22 extracted and the extracting jig 30 in two lines, the cooling member 61 having cross section of extracting direction of a square bracket is provided so as to extend along the three side surfaces of the ingot 22 while maintaining a certain distance from the surfaces.

By the sixth embodiment of the present invention, since the cooling member 61 having cross section of a square bracket is provided in the extracting area 50, heat radiation of the ingot 22 can be promoted more than in the case of the fifth embodiment, and thus cooling can be performed faster.

In the above explanation of the sixth embodiment, the example in which ingots are produced in two lines is explained; however, the present embodiment is not limited to the production of ingots in two lines, and for example, production in which combination of the ingot and the cooling member is provided multiply, in three or more lines, is possible.

In addition, the two cooling member having a cross section of a square bracket shape shown in FIG. 13 can be provided so that they are mutually inverse.

Seventh Embodiment (Multiple Ingots+Square Shaped Cooling Member)

Figure 14A:
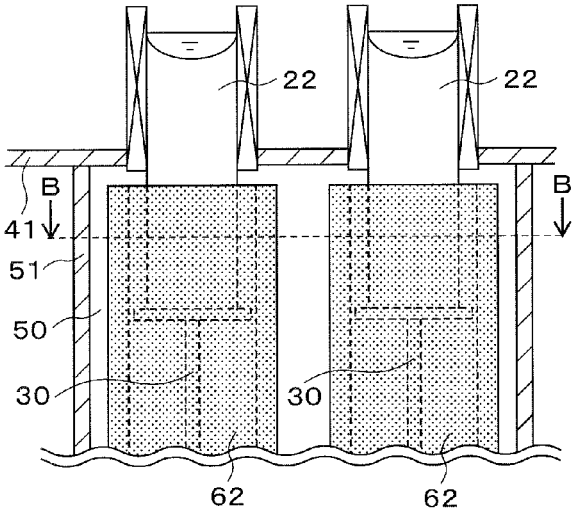
FIG. 14A is a cross sectional side view of the ingot extracting area.
Figure 14B:
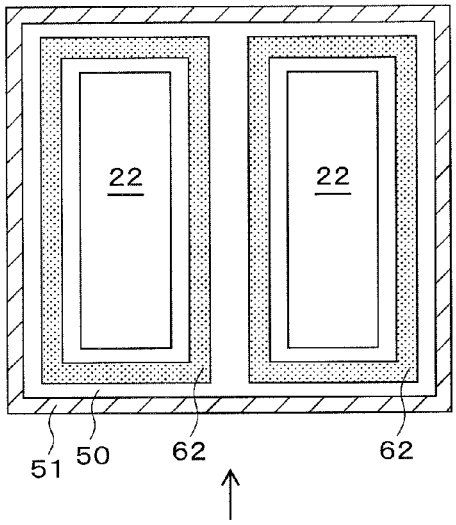
FIG. 14B is a cross sectional view of FIG. 14A taken along line B-B.

In the seventh embodiment of the present invention, as shown in FIG. 14, a cooling member having cross section of a square shape is provided in the extracting area 50. FIG. 14A is a cross sectional side view of the extracting area 50, and FIG. 14B is a cross sectional view of FIG. 14A taken along line B-B.

As shown in FIG. 14, at four sides of each combination of the ingot 22 extracted and the extracting jig 30 in two lines, the cooling member 62 having a cross section in the extracting direction of a square shape is provided so as to extend along the four side surfaces of the ingot 22 while maintaining a certain distance to the surfaces.

By the seventh embodiment of the present invention, since the cooling member 62 having a cross section of the shape of a square is provided in the extracting area 50, the ingot can be cooled from all directions, heat radiation of the ingot 22 can be promoted more than in the case of the fifth and sixth embodiments, and thus cooling can be performed more rapidly.

In the above explanation of the seventh embodiment, the example in which ingots are produced in two lines is explained; however, the present embodiment is not limited to the production of ingots in two lines, such as an example of production in which combination of the ingot and the cooling member is provided multiply, in three or more lines, is possible.

Eighth Embodiment [Multiple Ingots+Coil Shaped Cooling Member]

Figure 15A:
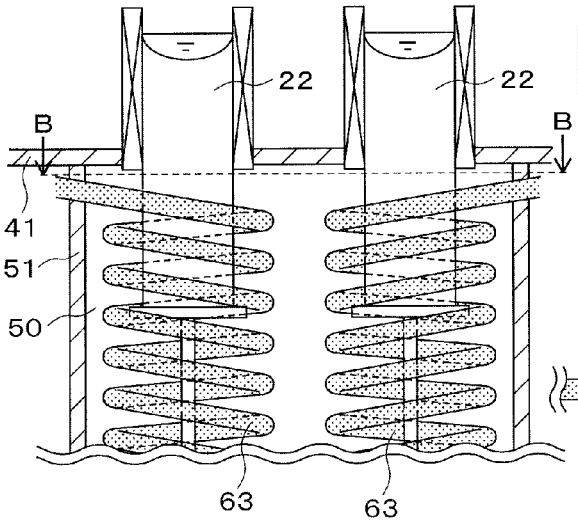
FIG. 15A is a cross sectional side view of the ingot extracting area.
Figure 15B:
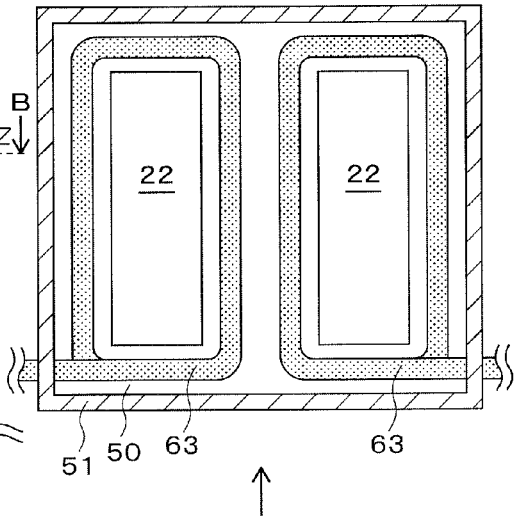
FIG. 15B is a cross sectional view of FIG. 15A taken along line B-B.

In the eighth embodiment of the present invention, as shown in FIG. 15, a cooling member consisting of a spiral coil is provided in the extracting area 50. FIG. 15A is a cross sectional side view of the extracting area 50, and FIG. 15B is a cross sectional view of FIG. 15A taken along line B-B.

As shown in FIG. 15, the cooling member 63 having a spiral coil shape is surrounding the four sides of the each combination of the ingot 22 extracted and the extracting jig 30 in two lines, so as to extend along the four side surfaces of the ingot 22 while maintaining a certain distance to the surfaces.

By the eighth embodiment of the present invention, since the cooling member 63 having a coil shape is provided in the extracting area 50, the ingot can be cooled from all directions, heat radiation of the ingot 22 can be promoted the same as in the seventh embodiment, and thus cooling can be performed more rapidly.

In the above explanation of the eighth embodiment, the example in which ingots are produced in two lines is explained; however, the present embodiment is not limited to the production of ingots in two lines, and for example, production in which combination of the ingot and the cooling member is provided multiply, in three or more lines, is possible.

Ninth Embodiment (Multiple Ingots+Triangular Pillar Shaped Cooling Member)

Figure 16:
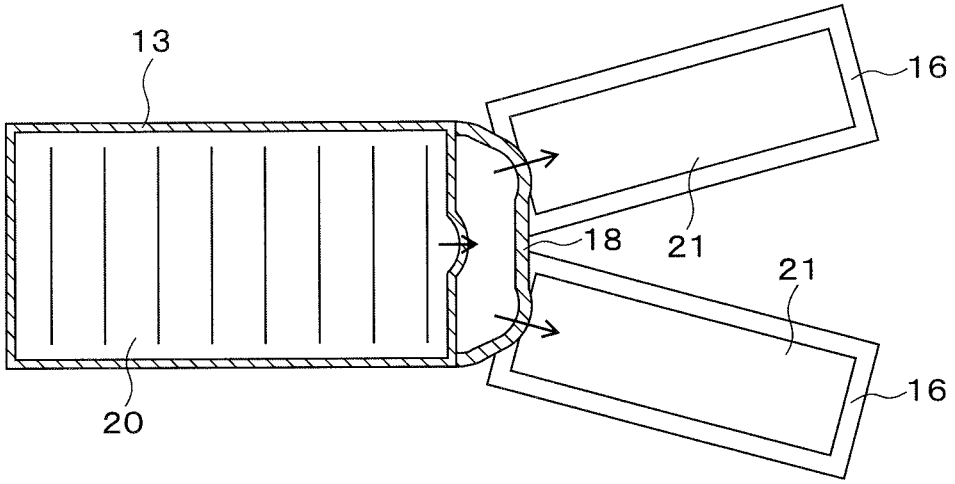
FIG. 16 is a partial plane view showing a melting area of one Embodiment of the present invention.

Next, another embodiment of the present invention is explained. FIG. 16 shows an example in which arrangement of multiple molds is changed in the melting area 40 of the electron beam melting furnace of the present invention. As shown in FIG. 16, two molds 16 are provided so that their edges of longitudinal direction are not parallel. A sluice 18 that once holds molten metal 20 and separates it into each of the multiple molds 16, is provided between the hearth 13 and the molds 16.

Figure 17:
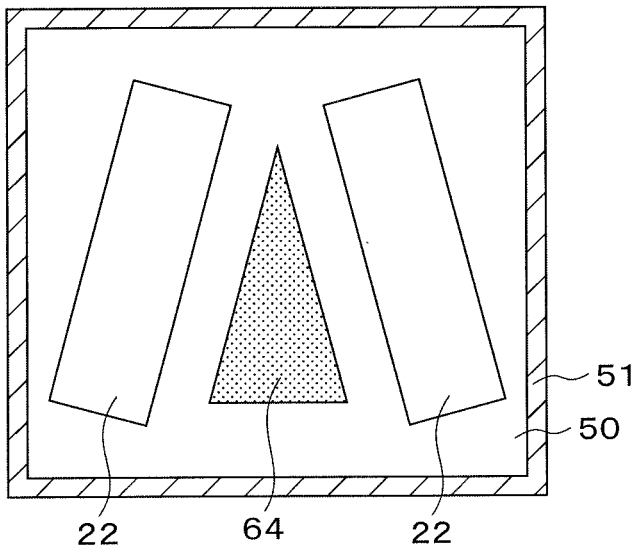
FIG. 17 is a cross sectional view showing an ingot extracting area of the Embodiment of FIG. 16.

FIG. 17 shows a cross sectional view in a case in which ingots produced in the melting area 40 shown in FIG. 16 are extracted to the extracting area 50. As shown in FIG. 17, the ingots 22 in two lines extracted are provided so that cross sectional view becomes like that of a circumflex without a peak. In a space between the ingots in two lines, a cooling member 64 having a triangular pillar shape (prism shape) is provided so that two surfaces of the triangular pillar extend parallel to each surface of the ingots 22 while having a certain gap between the surface of the triangular pillar and the surface of the ingot 22.

By the ninth embodiment of the present invention, even in a case in which surfaces of the ingots in two lines are not parallel to each other, since the cooling member provided between the ingots is a triangular pillar and two surfaces thereof face each surface of the ingots in parallel, heat radiation can be also promoted even between the ingots, and thus cooling can be performed faster. As a result, uniform cooling from all of the surfaces of the ingots is possible.

Tenth Embodiment (Multiple Ingots+Triangular Pillar Shaped Cooling Member)

Figure 18:
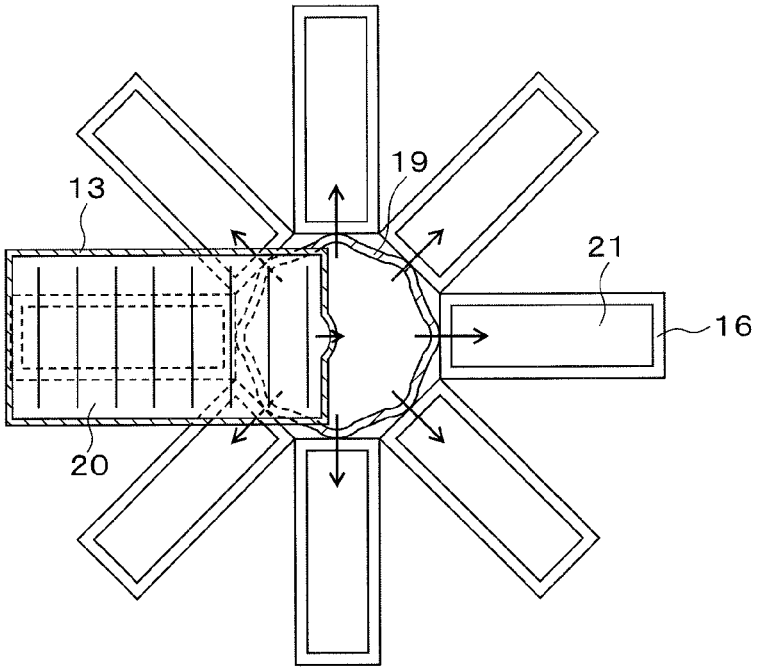
FIG. 18 is a partial plane view showing a melting area of one Embodiment of the present invention.

FIG. 18 shows an example in which arrangement of the mold 16 is changed in the melting area 40 of the electron beam melting furnace of the present invention. As shown in FIG. 18, the multiple molds 16 are provided so that longitudinal surfaces thereof are provided in a radial fashion. A sluice 19 that divides the molten metal 20 radially to each mold 16 is provided between the hearth 13 and molds 16.

Figure 19:
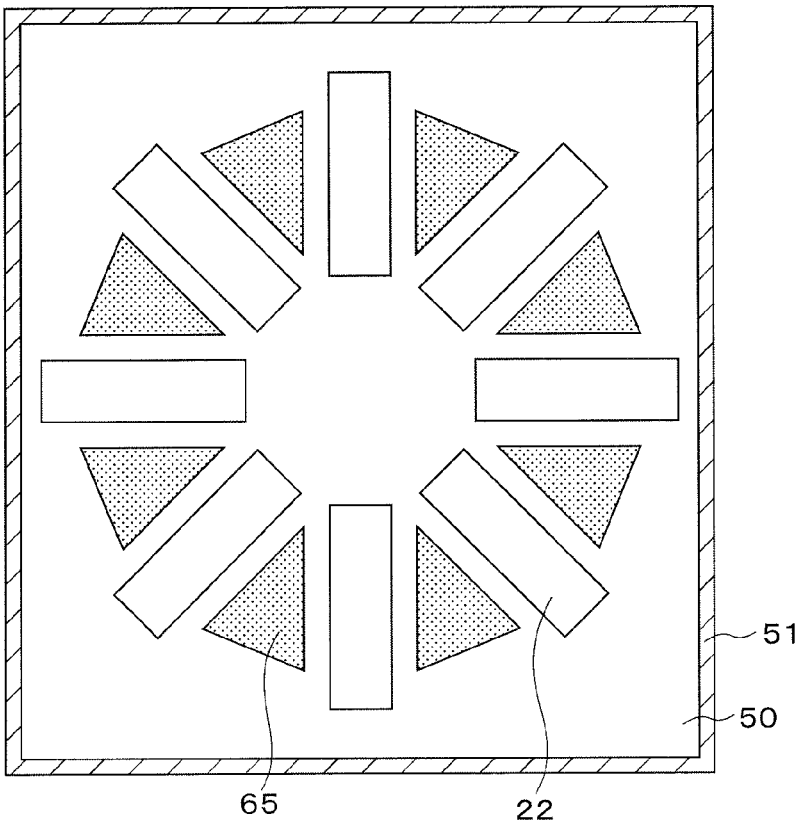
FIG. 19 is a cross sectional view showing an ingot extracting area of the Embodiment of FIG. 18.

FIG. 19 shows a cross sectional view in a case in which ingots produced in the melting area 40 shown in FIG. 18 are extracted at the extracting area 50. As shown in FIG. 19, the multiple ingots 22 extracted are provided in a radial fashion. In each space formed between the adjacent ingots in two lines, a cooling member 65 having a triangular pillar shape is provided so that two surface thereof extend parallel to the surface of each ingots 22 with having a certain gap.

By the tenth embodiment of the present invention, even in a case in which ingots are provided in a radial fashion and surfaces of the ingots are not parallel to each other, since the cooling member provided between the ingots is a triangular pillar and two surfaces thereof face each surface of the ingots in parallel, heat radiation can also be promoted even between the ingots, and thus cooling can be performed more rapidly. As a result, uniform cooling from all of the surfaces of the ingots is possible. In addition, by the present embodiment, multiple ingots can be efficiently produced in a limited space.

Other Variation (Nonrectangular Ingot+Cooling Member)

Figure 20A:
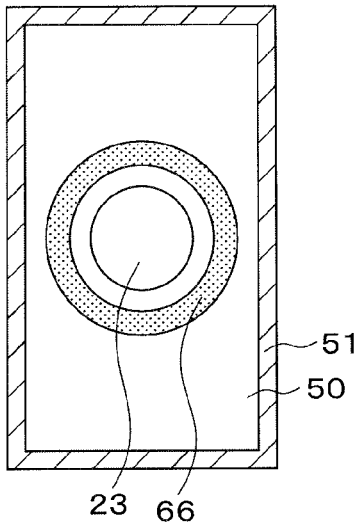
FIGS. 20A to 20C are cross sectional views showing an ingot extracting portion of one example of another modified example of the present invention.

FIG. 20 shows a cross sectional view of ingot extracted in another variation of the present invention. As shown in FIG. 20A, the present invention can be employed in ingot 23 having circular cross section. In a manner similar to the case of a rectangular ingot, a cooling member 66 in this case has a circular cross section that surrounds all of the circumference of the ingot while having a certain gap from the surface of the ingot 23, and extends along an extracting direction of the ingot.

Figure 20B:
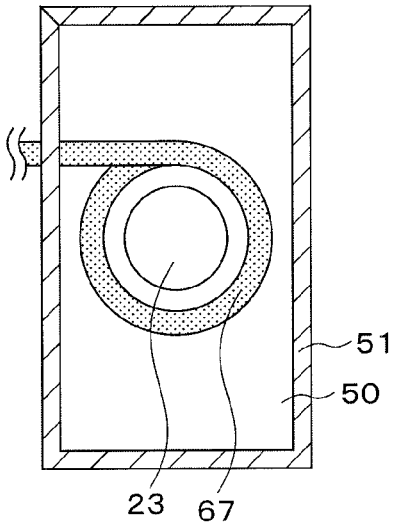

Furthermore, as shown in FIG. 20B, it is possible for a coil shaped cooling member 67 to surround the entirety of the circumference of the circular ingot.

Figure 20C:
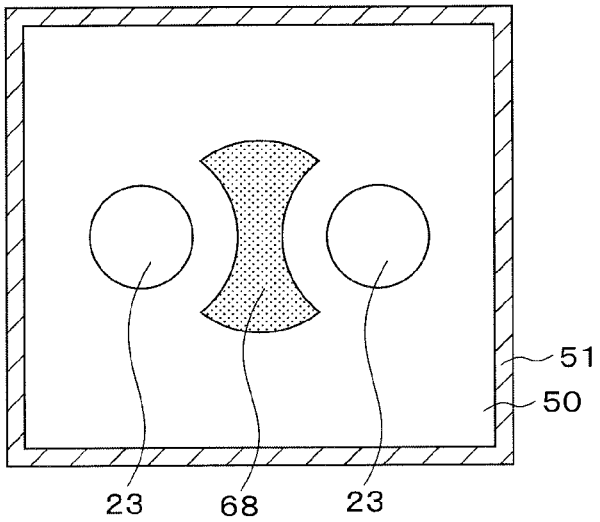

Furthermore, in a manner similar to the explanation of embodiments of a rectangular ingot, multiple combinations of an ingot 23 and a cooling member shown in FIGS. 20A and 20B can be provided in parallel. In addition, as shown in FIG. 20C, a cooling member 68 that surrounds part of a circumference of a circular ingot can be provided between the multiple circular ingots 23.

Figure 21:
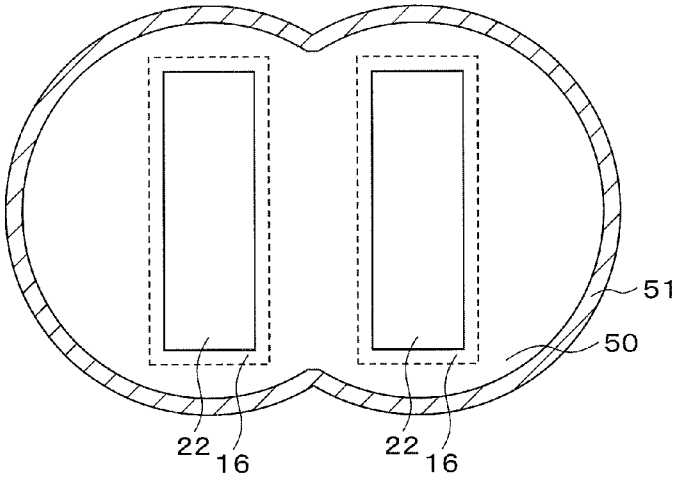
FIG. 21 is a cross sectional view showing an ingot extracting portion of one example of another modified example of the present invention.

Furthermore, as shown in plane view in FIG. 21, multiple molds 16 are provided in parallel in the melting area 40, and in the extracting area 50 below the melting area, an extracting area outer case 51 can have a structure in which two cases, each having a letter C shaped cross section surrounding part of ingot and being open partially are combined. It should be noted that FIG. 21 shows a variation of the extracting area outer case 51, although description of the cooling member is omitted in the figure, each kind of cooling member explained in the present invention can be provided in FIG. 21 in practical use.

Figure 22A:
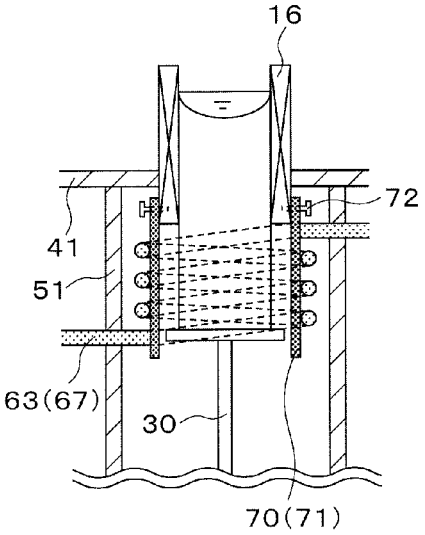
FIG. 22A is a cross sectional side view of the ingot extracting area.
Figure 22B:
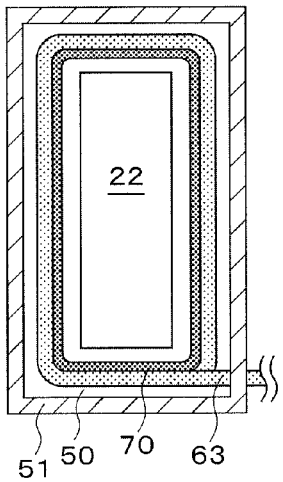
FIGS. 22B and 22C are cross sectional plane views of FIG. 22A.
Figure 22C:
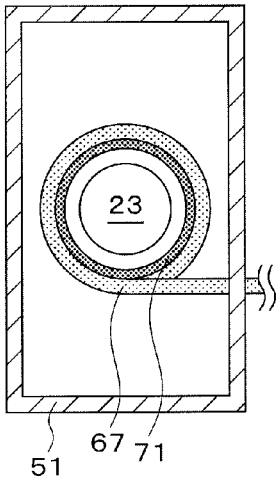

Furthermore, as shown in FIG. 22, in the present invention, not arranging the cooling member from lower direction of the ingot as explained so far, a structure in which a tabular member consisting of a copper plate or the like is attached at a lower edge of the mold 16 by fixing jig 72 so as to extend the mold 16 from an upper direction to a lower direction, can be employed, for example. A tabular member 70 or 71 can be provided so as to surround the ingot, as shown in FIG. 22B in a case in which ingot cross section is a rectangle, and as shown in FIG. 22C in a case in which the ingot cross section is a circle. In both cases, a coil shape cooling member 63 or 67 is provided around the tabular member 70 or 71 respectively, and ingot can be cooled via the tabular member by heat absorption of the cooling member.

A feature of the present invention is that the cooling member is provided between the multiple ingots, and/or between the outer case and the ingot. Among these, in the embodiment in which the cooling member is provided between the multiple ingots, as already explained in FIG. 12, mutual heating between the ingots 22 extracted from the molds at high temperature can be effectively reduced by arranging the cooling member 60 between the ingots 22.

Figure 23A:
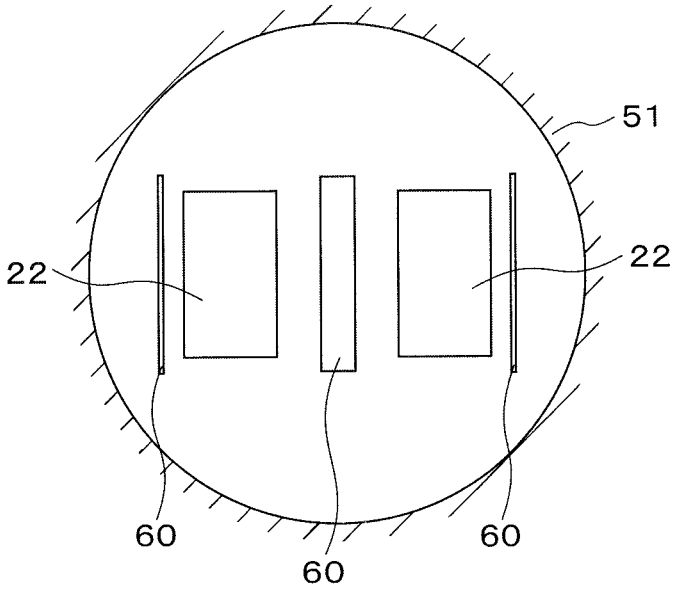
FIG. 23A is a cross sectional plane view.
Figure 23B:
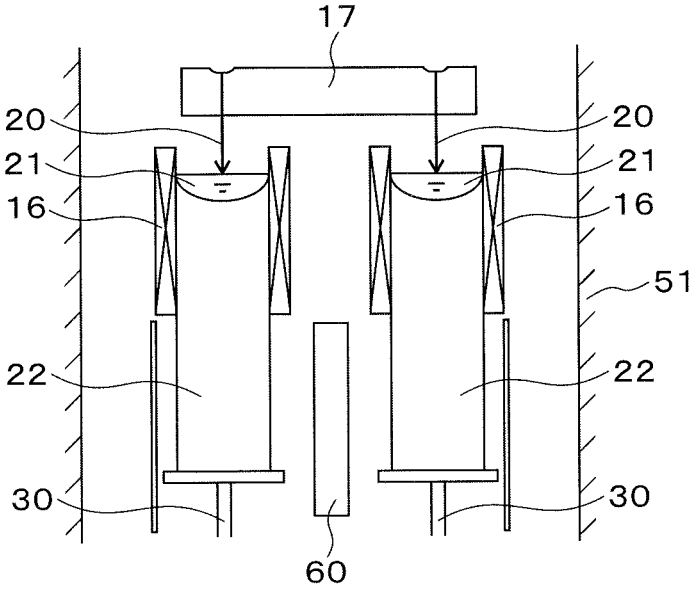
FIG. 23B is a cross sectional side view.

In addition, although description is omitted in the figure, the cooling member can be provided between the ingot 22 and the outer case 51. Furthermore, by combining both embodiments as shown in FIG. 23, the cooling member can be provided both between the multiple ingots 22 and between the ingot 22 and the outer case 51.

If the mutual heating between the ingots 22 is reduced, there will be no gradient of temperature distribution along a cross sectional direction in each ingot 22 extracted from the mold. As a result, thermal deformation of ingot that is produced can also be effectively reduced. Finally, an ingot having superior linear properties can be produced.

In the present invention, it is preferable that the temperature gradient in which temperature decreases from a top part of a cooling member to a bottom part of the cooling member, is given to a cooling member provided along a vertical direction. As a result, compared to a case in which such temperature gradient is not given to the cooling member, the casting surface of the ingot produced is improved.

Furthermore, in the present invention, it is preferable that the temperature gradient in which temperature decreases from a bottom part of a cooling member to a top part of the cooling member, is given to a cooling member provided along a vertical direction. As a result, compared to a case in which such a temperature gradient is not given to the cooling member, linearity of the ingot produced is improved.

Figure 24A:
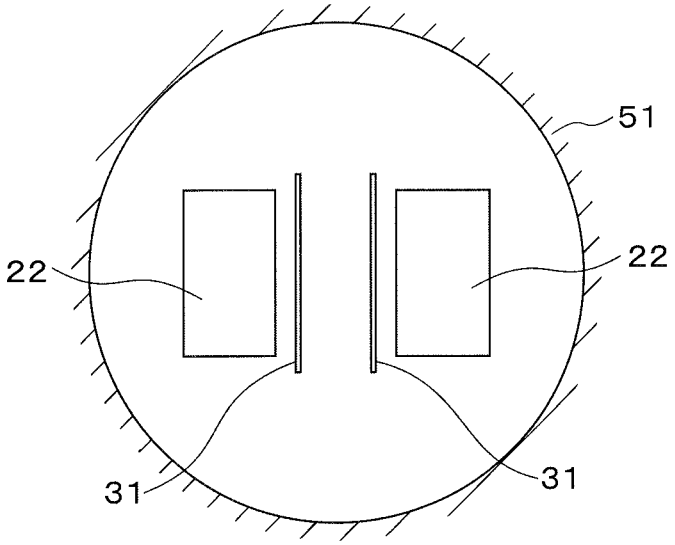
FIG. 24A is a cross sectional plane view.
Figure 24B:
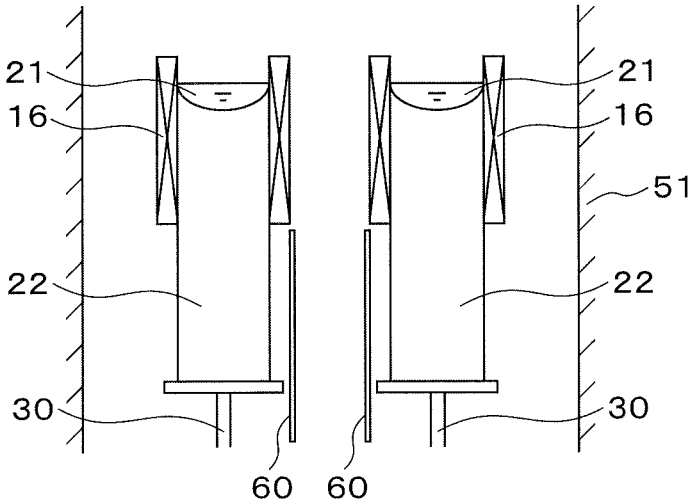
FIG. 24B is a cross sectional side view.

FIG. 24 shows another preferable embodiment of the present invention, in which a cooling member 60 is provided at each surface of the two ingots 22 facing each other, in a condition in which no temperature gradient is produced in the cooling members 60. By this embodiment, mutual heating between the ingots can be reduced more, and as a result, warping of the ingot can be improved more than in the embodiment of FIG. 12.

Figure 25A:
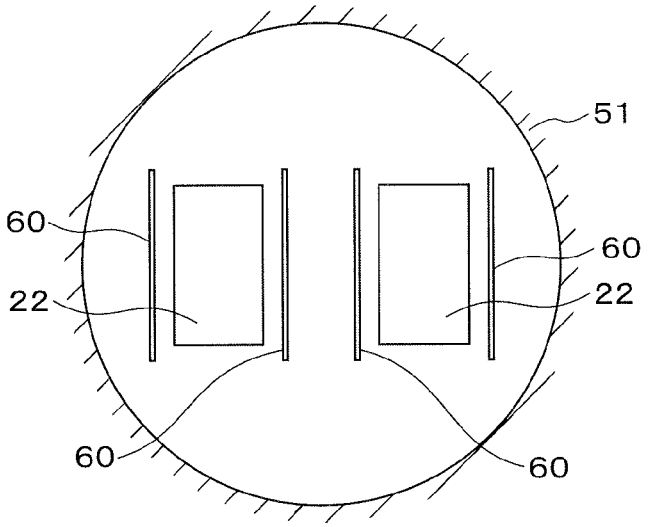
FIG. 25A is a cross sectional plane view.
Figure 25B:
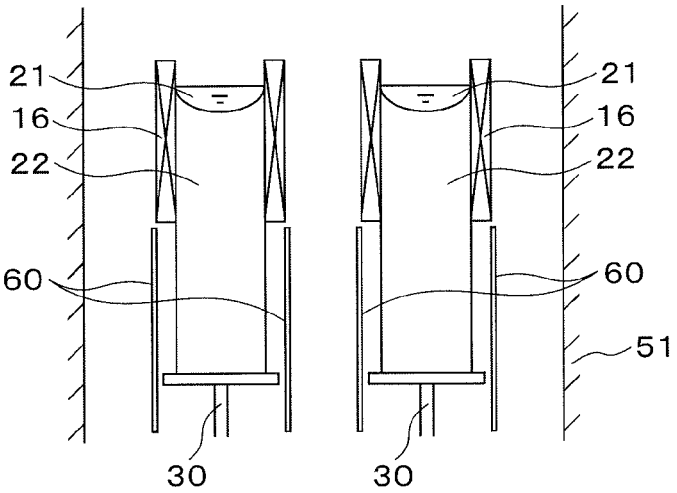
FIG. 25B is a cross sectional side view.

FIG. 25 shows another preferable embodiment of the present invention, in which a cooling member 60 is provided at each surface of the two ingots 22 facing each other and at each surface of the ingots 22 facing the outer case, in a condition in which no temperature gradient is given to the cooling members 60. By this embodiment, mutual heating between the ingots can be reduced more, the cooling rate is increased, and as a result, not only can warping of the ingot be further improved, but also the extracting rate of the ingot produced can be increased.

Figure 26:
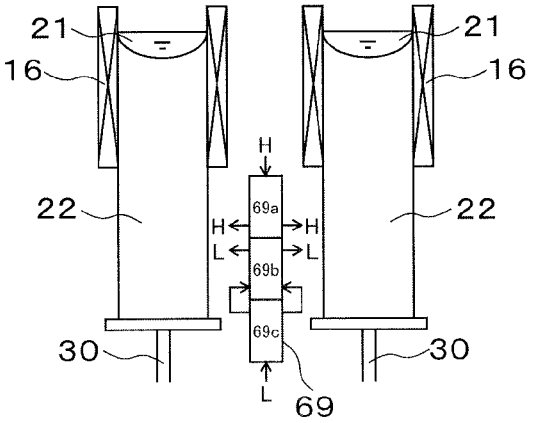
FIG. 26 is a cross sectional side view showing conceptually an electron beam melting furnace of one Embodiment of the present invention.

FIG. 26 shows a preferable embodiment of the present invention, which is a cooling member 69 in which there is a temperature gradient. It shows an example of a method to produce such a gradient, which is a structure for flowing cooling water therethrough. Along a vertical direction, the inside of the cooling member 69 is divided into multiple areas by a dividing wall, and the top, middle, and bottom portions are called first portion 69*a*, second portion 69*b*, and third portion 69*c*, respectively.

In the structure of this embodiment, hot water (H) is supplied to the first portion 69*a*, and the hot water (H) is expelled from the portion. It is preferable that the temperature of the hot water supplied to the first portion 69*a* be in a range from 50 to 70° C.

In addition, it is preferable that cold water (L) be supplied to bottom of the third portion 69*c*, that the cold water (L) be expelled from top of the portion, and that the cold water (L) that is expelled be supplied to a bottom of the second portion 69*b*. It is preferable that temperature of the cold water supplied be in a range from 5 to 20° C.

By producing a negative temperature gradient in which temperature decreases from the top to the bottom in the cooling member 69, as mentioned above, since the ingot 22 just after it is extracted from the mold 16 is cooled step by step, and is not cooled suddenly, therefore, the casting surface of the ingot 22 produced can be improved.

Furthermore, in the present invention, although not shown in the figure, it is possible for the cold water (L) to be supplied to the first portion 69*a* and the second portion 69*b*, and for the hot water (H) to be supplied to the third portion 69*c*, unlike in the FIG. 26.

By giving a positive temperature gradient, in which temperature increases from the top to the bottom in the cooling member 69 as mentioned above, since mutual heating between the ingots 22 just after extracted from the mold 16 is reduced, it is therefore possible for the temperature distribution in the ingot to be prevented from being nonuniform, and linearity of the ingot can be improved.

Although description in figure is omitted, the present invention is not limited to an ingot having a cross section of a rectangle and a circle, and the present invention can be employed for any other ingots having cross sectional shapes such as an ellipse, barrel, polygon, or other irregular shapes formed by curve, as long as it can be practically produced, and can be employed to a case of ingots in single line and in a case of ingots in multiple lines. In each case, the cooling member of the present invention has a shape surrounding all or part of circumference of the ingot surface, and extends along the ingot surface while having a certain gap from the ingot surface.

The cooling member for cooling a metallic ingot is made of a metal having good heat conductivity, and it is preferable that a cooling medium be used in the member itself. As the cooling method, a method in which all surfaces of a copper member are cooled by being a jacket structure of the member, a method in which a cooling medium is flowing through a pathway in advance formed in the cooling member so as to cool the member, and a method in which a metallic pipe is provided at the surface of the cooling member in a coil shape so as to cool the cooling member, can be mentioned. By employing one of these methods, heat in the ingot can be efficiently removed.

As a material for the cooling member, any materials which exhibit heat conduction effects can be selected, and for example metals, ceramics, heat-resistant engineering plastics or the like can be mentioned, and in particular, in the present invention, among these materials, material having superior heat conductivity such as copper, aluminum, iron or the like is desirably used.

As a cooling medium, water, organic solvent, oil or gas can be used.

In another cooling method for the cooling member, a method using the so-called Peltier effect, which is exhibited by bonding two or more kinds of different metals and applying direct current to the member, may be mentioned. In this method, one surface of the member of the Peltier element facing to the ingot is cooled, while the opposite surface of the member radiates heat. This method can be used alone or by combining with another cooling method explained so far. In this case, as the member, cladding material of copper and constantan (a copper-nickel alloy) or cladding material of copper and a nickel chromium alloy, can be desirably used.

Eleventh Embodiment (Mold Having One Kind of Cooling Material+Thickness Increasing Portion+Parallel Portion)

Figure 27A:
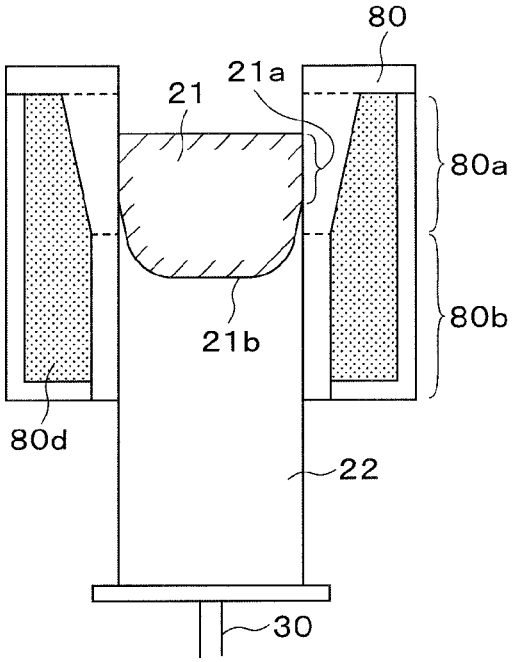
FIG. 27A is a conceptual cross sectional view showing a mold part of one Embodiment of the present invention.

A desirable embodiment of the mold 16 of the electron beam melting furnace in FIG. 1 is explained as follows. FIG. 27A is an enlarged view of the mold 16 in FIG. 1.

A mold 80 of the present embodiment consists of a first cooling portion (thickness increasing portion) 80*a* which is an upper part of the mold, and a second cooling portion (parallel portion) 80*b* which is a lower part of the mold. The first cooling portion (thickness increasing portion) 80*a* is provided from a region corresponding to a meniscus portion 21*a* in which a liquid phase of mold pool 21 of the molten metal held in the mold 16 directly contacts with an upper region than the meniscus portion. In the first cooling portion, thickness of the mold wall increases in the upper direction.

The second cooling portion (parallel portion) 80*b* is provided from a region corresponding to a part where a solid phase of the mold pool 21 contacts, to a lower region than the part. In the second cooling portion, thickness of the mold wall is constant.

At the outside of the mold 80, cooling medium 80*d* is supplied to the thickness increasing portion 80*a* and the parallel portion 80*b* in common.

First, the raw material 12 supplied from the raw material supplying device 10 is melted by the electron beam gun 14 in the hearth 13 so as to form the molten metal 20. The molten metal 20 is supplied from downstream of the hearth 13 to inside of the mold 16. A stub not shown in the figure is provided in the mold 16 before melting of the raw material 12, this stub functions as a bottom part of the mold 16. The stub consists of as similar metal as the raw material 12, and forms ingot 22 by being unified with the molten metal 20 supplied in the mold 16.

Surface of the molten metal 20 continuously supplied on the stub in the mold 16 is heated by the electron beam gun 15 so as to form molten metal pool 21. Bottom part of the molten metal pool 21 is cooled and solidified by the mold 16, and forms ingot 22 by unifying with the stub. The ingot 22 generated in the mold 16 is extracted to the extracting area 50 while controlling extracting rate of the extracting jig 30 engaged to the stub so that level of the molten metal pool 21 becomes constant.

Figure 31A:
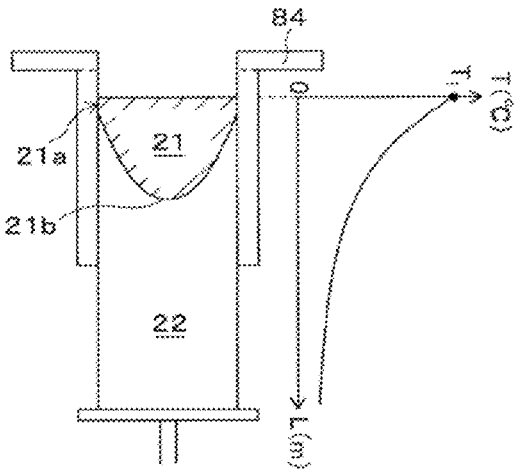
Fig. 31A PRIOR ART
FIG. 31 is a conceptual view showing a situation of formation of a mold pool and a situation of heat radiation in a conventional mold (FIG. 31A) and in the mold of the present invention (FIG. 31B).
Figure 31B:
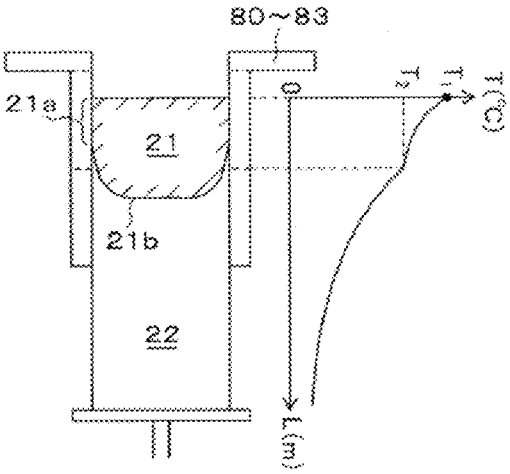
Figure 32:
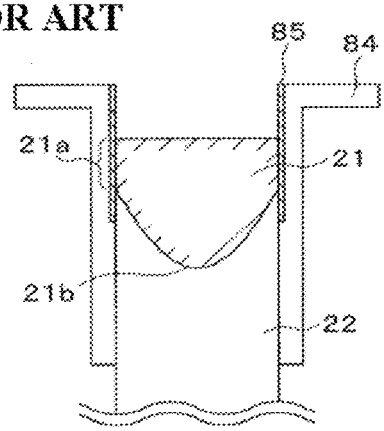
Fig. 32 PRIOR ART
FIG. 32 is a conceptual cross sectional view showing mold parts in a conventional electron beam melting furnace.

The feature of the present embodiment is that temperature distribution in which temperature monotonically decreases from the top part to the bottom part of the mold wall is given to the mold wall, and that there is at least one inflection point in the temperature distribution, as shown in FIG. 31B. By forming such a temperature distribution as mentioned above, compared to a conventional mold in which a wall as shown in the secondary cooling member is formed in parallel to the primary cooling member, heat absorption amount can be further reduced, and as a result, the casting surface of the ingot produced can be improved.

That is, as arranging the temperature distribution as mentioned above, since cooling is relatively mild at the primary cooling portion 80*a* so that the mold pool is maintained at high temperature, the meniscus portion 21*a* can be formed so as to be long. On the other hand, since cooling is relatively rapid at the secondary cooling portion 80*b*, solidification is promoted, the solid-liquid interface 21*b* at the bottom part of the mold pool has a broader shape than a parabola shape, that is, a shallow mold pool can be formed. In this way, mixing of molten metal is promoted even around the vicinity of the bottom part of the mold pool 21, and the ingot extracted is prevented from being affected by the bottom portion of the mold pool, which is a melted part. As a result, an ingot having a superior casting surface can be produced.

FIG. 31 shows a difference between the mold of the present invention and that of a conventional one. FIG. 31A shows a conventional one, and FIG. 31B is that of the present invention. As shown in FIG. 31A, since the solid-liquid interface 21*b* has a parabolic shape in the conventional one, mixing of the molten metal components is interrupted around the bottom part. In addition, in a case in which an attempt is made to make the meniscus portion 21*a* to be formed longer by increasing melting energy, a position of a convex portion of the parabola of the bottom part becomes lower, and thus the ingot extracted is affected. However, in the present invention, even in a case in which the meniscus portion 21*a* is formed longer, the bottom part of the mold pool 21 protrudes less than the parabolic shape, and thus the effects mentioned above are obtained.

In addition, the situation of temperature depending on position (coordinate L) in the mold is described as a conceptual graph in FIG. 31. As shown in FIG. 31, since cooling is monotonic in the conventional case (31A), a temperature curve is approximately described by a single decay curve using the natural logarithm from the highest temperature $T_1$; however, in the case of the present invention (31B), since cooling is performed in two steps, by the primary cooling part and the secondary cooling part, a temperature curve is approximately described by a decay curve in which temperature is mildly decreased from the highest temperature $T_1$ to $T_2$, and a decay curve in which temperature is rapidly decreased from $T_2$.

It should be noted that a curve convex in the lower direction is shown in FIG. 31B, which is the present invention; however, the present invention includes a preferred embodiment in which temperature the distribution is shown by a curve convex to the upper direction. Furthermore, the present invention includes an embodiment in which there is at least one inflection point in the graph.

Twelfth Embodiment (Mold Having Two Kinds of Cooling Medium)

Hereinafter twelfth to fourteenth embodiments of the melting furnace for producing metal are explained. In the following embodiments, explanation of construction elements that are the same as in the twelfth embodiment is omitted, and only a mold part that is different is explained.

Figure 28A:
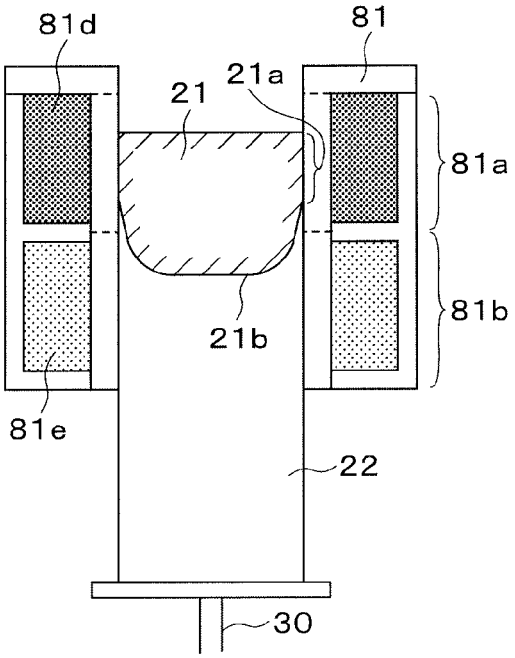
FIG. 28A is a conceptual cross sectional view showing a mold part of another Embodiment of the present invention.
Figure 28B:
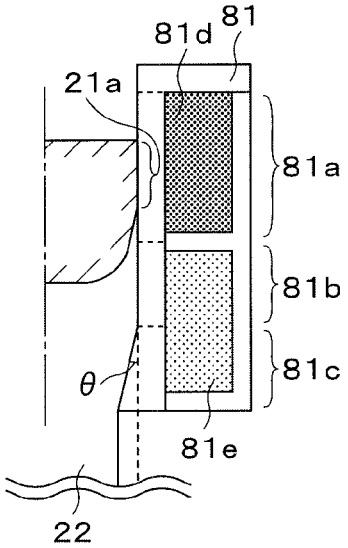
FIG. 28B is a conceptual cross sectional view showing an example in which a taper portion is provided.

FIG. 28A shows an enlarged view of a mold 81 of the present embodiment. The mold 81 consists of a primary cooling portion 81*a* that is an upper part of the mold and a secondary cooling portion 81*b* that is a lower part of the mold. The primary cooling portion 81*a* is provided for a portion corresponding to the meniscus portion 21*a* in which a liquid phase of the mold pool 21 of the molten metal held in the mold 81 directly contacts the mold 81 and an upper region. The secondary cooling portion 81*b* is provided for a portion corresponding to a part in which solid phase of the mold pool 21 contacts the mold 81 and a lower region. Thickness of these mold walls is constant, unlike those of the eleventh embodiment.

At the outside of the mold 81, mutually separate divided pathways are formed, and a primary cooling medium 81*d* and a secondary cooling medium 81*e* are supplied to cool the primary cooling portion 81*a* and the secondary cooling portion 81*b* of the mold, respectively. Temperature of the primary cooling medium 81*d* is higher than that of the secondary cooling medium 81*e*. Therefore, heat absorption amount of the primary cooling portion 81*a* is small and that of the secondary cooling portion 81*b* is large.

By this structure, since cooling is relatively mild in the primary cooling portion 81*a*, and thus the mold pool is maintained at a high temperature, the meniscus portion 21*a* can be formed longer; on the other hand, since cooling is relatively rapid in the secondary cooling portion 81*b* and thus solidification is promoted, the solid-liquid interface 21*b* at the bottom part of the mold pool can be formed in a broader shape than a parabolic shape, that is, the mold pool can be formed to be shallow. By this structure, mixing of the molten metal components is promoted even around the bottom part of the mold pool 21, and thus the ingot extracted is prevented from being affected by the bottom portion of the mold pool that is a melted portion. As a result, an ingot having a superior casting surface can be produced.

Thirteenth Embodiment (Mold Having One Kind Cooling Medium+Single Coil)

Figure 29A:
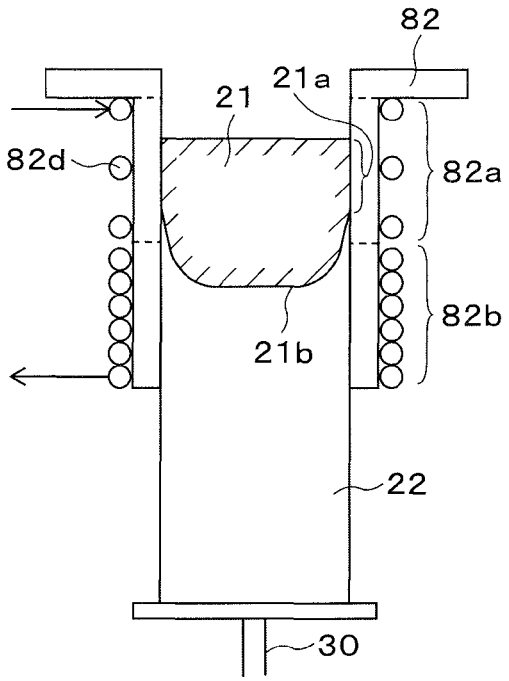
FIG. 29A is a conceptual cross sectional view showing a mold part of another Embodiment of the present invention.
Figure 29B:
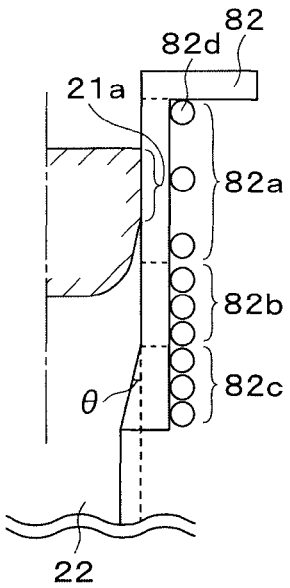
FIG. 29B is a conceptual cross sectional view showing an example in which a taper portion is provided.

FIG. 29A shows an enlarged view of a mold 82 of the present embodiment. The mold 82 consists of a primary cooling portion 82*a* that is an upper part of the mold and a secondary cooling portion 82*b* that is a lower part of the mold. The primary cooling portion 82*a* is provided for a portion corresponding to the meniscus portion 21*a* in which a liquid phase of the mold pool 21 of the molten metal held in the mold 82 directly contacts the mold 82 and an upper region. The secondary cooling portion 82*b* is provided for a portion corresponding to a part in which a solid phase of the mold pool 21 contacts the mold 82 and a lower region. Thickness of these mold walls is constant.

Outside of the mold 82, a single coil is wound. The coil is wound relatively sparsely around a part corresponding to the primary cooling portion 82*a*, and is wound relatively densely around a part corresponding to the secondary cooling portion 82*b*. A cooling medium 82*d* is supplied to the single coil.

In this embodiment, since the coil is sparsely wound (the number of coils is small) around the primary cooling portion 82*a* and is densely wound (the number of coils is large) around the secondary cooling portion 82*b*, the heat absorption amount is proportion to the number of the coil windings, and thus the heat absorption amount at the primary cooling portion 82*a* is small and the heat absorption amount at the secondary cooling portion 82*b* is large.

By this structure, since cooling is relatively mild in the primary cooling portion 82*a*, and thus the mold pool is maintained at a high temperature, the meniscus portion 21*a* can be formed longer; on the other hand, since cooling is relatively rapid in the secondary cooling portion 82*b*, and thus solidification is promoted, the solid-liquid interface 21*b* at the bottom part of the mold pool can be formed in a broader shape than a parabolic shape, that is, the mold pool can be formed so as to be shallow. By this structure, mixing of the molten metal components is promoted even around the bottom part of the mold pool 21, and thus the ingot extracted, is prevented from being affected by the bottom portion of the mold pool, which is the melted portion. As a result, an ingot having a superior casting surface can be produced.

Fourteenth Embodiment (Mold Having Two Kinds of Cooling Medium+Two Coils)

Figure 30A:
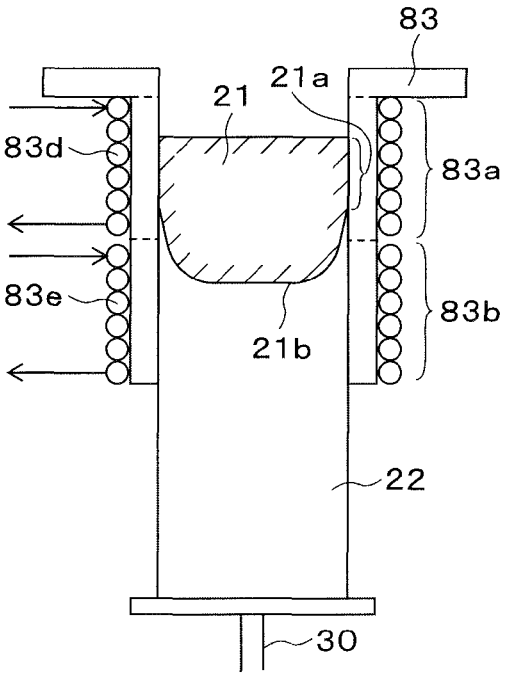
FIG. 30A is a conceptual cross sectional view showing a mold part of another Embodiment of the present invention.
Figure 30B:
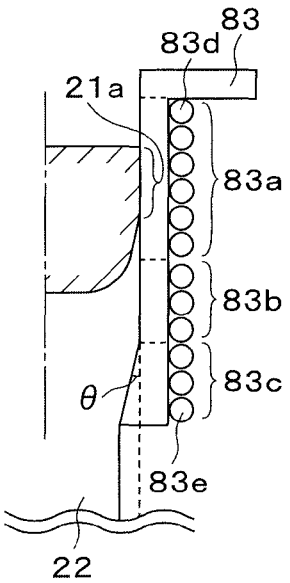
FIG. 30B is a conceptual cross sectional view showing an example in which a taper portion is provided.

FIG. 30A shows an enlarged view of a mold 83 of the present embodiment. The mold 83 consists of a primary cooling portion 83*a* that is an upper part of the mold and a secondary cooling portion 83*b* that is a lower part of the mold. The primary cooling portion 83*a* is provided for a portion corresponding to the meniscus portion 21*a* in which a liquid phase of the mold pool 21 of the molten metal held in the mold 83 directly contacts the mold 83 and an upper region. The secondary cooling portion 83*b* is provided for a portion corresponding to a part in which a solid phase of the mold pool 21 contacts the mold and a lower region. Thickness of these mold walls is constant.

Outside of the mold 83, two coils are wound so that two kinds of cooling medium can be separately supplied. Unlike in the thirteenth embodiment, a coil corresponding to the primary cooling portion 83*a* and a coil corresponding to the secondary cooling portion 83*b* are mutually separated. A cooling medium 83*d* having relatively higher temperature is supplied to the coil around the primary cooling portion 83*a*, and a cooling medium 83*e* having relatively lower temperature is supplied to the coil around the secondary cooling portion 83*b*.

In this embodiment, since the cooling medium of relatively higher temperature is supplied to the primary cooling portion 83*a* and the cooling medium of relatively lower temperature is supplied to the secondary cooling portion 83*b*, heat absorption amount at the primary cooling portion 83*a* is small and the heat absorption amount at the secondary cooling portion 83*b* is large.

By this structure, since cooling is relatively mild in the primary cooling portion 83*a*, and thus the mold pool is maintained at a high temperature, the meniscus portion 21 can be formed longer; on the other hand, since cooling is relatively rapid in the secondary cooling portion 83*b*, and thus solidification is promoted, the solid-liquid interface 21*b* at the bottom part of the mold pool can be formed in a broader shape than a parabolic shape, that is, the mold pool can be formed so as to be shallow. By this structure, mixing of the molten metal components is promoted even around the bottom part of the mold pool 21, and thus the ingot that is extracted is prevented from being affected by the bottom portion of the mold pool, which is a melted portion. As a result, an ingot having a superior casting surface can be produced.

Variation (Mold Having Tapered Part)

In addition to the molds 80 to 83 explained above, tapered portions 80*c* to 83*c*, can be provided at a lower end part of the secondary cooling portions 80*b* to 83*b*, respectively, as shown in FIGS. 27*b*, 28B, 29B, and 30B. The tapered portions 80*c* to 83*c* have a structure in which a diameter inside the mold is decrease and thickness is increased toward the lower direction.

By arranging the tapered portions 80*c* to 83*c*, compression by stress can be added to the surface of the ingot extracted in the molds 80 to 83, and as a result, the casting surface can be improved.

It is preferable that the tapering angle θ of the tapered portion in the present invention be in a range from 1 to 5 degrees. In a case in which the tapering angle θ is less than 1 degree, notable improvement in the casting surface is not obtained, and in a case in which the tapering angle θ is greater than 5 degrees, the ingot cannot be extracted from the mold.

In the embodiments of the present invention, it is preferable that the relationship of length of the primary cooling portion and the secondary cooling portion be in a range such that the primary cooling portion to the secondary cooling portion=45 to 55:45 to 55 in a case in which the tapered portion is not provided, and it is preferable that the primary cooling portion to the secondary cooling portion (portion except for the tapered portion) to the tapered portion=45 to 55:20 to 25:20 to 25 in a case in which the tapered portion is provided.

The preferable embodiment of the process for production of ingot using electron beam melting furnace mentioned above can be employed also in a plasma arc melting furnace, and as a result, an ingot having a superior casting surface and linearity can be produced.

By producing a metallic ingot by the present invention as described above, cooling can be performed rapidly, deterioration of the ingot by oxidation by the air can be reduced, and production efficiency of the ingot can be improved. Furthermore, since heat radiation from the ingot can be performed to all directions uniformly, deformation of the ingot due to nonuniform temperature distribution can be prevented.

In this way, in the melting furnace for producing metal of the present invention, by arranging at least one cooling member between ingots extracted from the mold, and/or between the ingot and the outer case, not only can warping of the ingot produced be effectively reduced, but also the casting surface of the ingot produced can be improved by arranging temperature distribution to the cooling member.

EXAMPLES

Hereinafter the present invention is explained in detail with reference to Examples and Comparative Examples.

Example 1

Using the electron beam melting furnace having a following apparatus construction, titanium ingots were produced.

1. Raw material for melting
   Titanium sponge (diameter range: 1 to 20 mm)
2. Apparatus construction
   1) Hearth (material and structure: water cooled copper hearth, molten metal exhaust ports: two)
   2) Mold (water cooled copper mold: one, cross sectional shape: rectangle)
   3) Cooling member (provided around ingot)
   Temperature of cooling water: 20° C.
   Temperature gradient: none
3. Ingot produced
   Shape: diameter 100
4. Ingot extracting mechanism
   An ingot extracting jig was provided below each mold, and the ingots were extracted at the same time.
5. Pressure controlling
   While monitoring a pressure meter provided in the furnace, pressure inside of the furnace was controlled within a certain range.

Time required for cooling ingot in a case in which the cooling member was provided surrounding circumference of the ingot (diameter 100) held at 1000° C. to 300° C. in the mold 16 as shown in FIG. 10, and the time required for cooling the ingot in a case in which the cooling member was not used, were measured. Here, water cooled cooper was used as a cooling member.

TABLE 1

| Cooling member | Provided | Not Provided |
|---|---|---|
| Cooling time (min) | 60 | 180 |

Example 2

Time required for cooling the ingot was measured under conditions similar to those in Example 1, except that the cooling member shown in FIG. 11 was used instead of that shown in FIG. 10.

TABLE 2

| Cooling member | Provided | Not Provided |
|---|---|---|
| Cooling time (min) | 100 | 180 |

Example 3

Time required for cooling the ingot was measured under conditions similar to those in Example 1, except that two ingots were produced by two molds, and except that the cooling member shown in FIG. 12 was used instead of that shown in FIG. 10.

TABLE 3

| Cooling member | Provided | Not Provided |
|---|---|---|
| Cooling time (min) | 120 | 300 |

Example 4

Time required for cooling the ingot was measured under conditions similar to those in Example 1, except that two ingots were produced by two molds, and except that the cooling member shown in FIG. 14 was used instead of that shown in FIG. 10.

TABLE 4

| Cooling member | Provided | Not Provided |
|---|---|---|
| Cooling time (min) | 60 | 300 |

Example 5

Time required for cooling the ingot was measured under conditions similar to those in Example 1, except that two ingots were produced by two molds, and except that the cooling member shown in FIG. 15 was used instead of that shown in FIG. 10.

TABLE 5

| Cooling member | Provided | Not provided |
|---|---|---|
| Cooling time (min) | 100 | 300 |

Example 6

As a result of two ingots being produced and extracted at the same time under conditions similar to those in Example 1 except that two ingots were produced by two molds and except that apparatus construction shown in FIG. 12 was employed, double the productivity could be obtained compared to a case in which a pair of mold and extracting jig was used. Furthermore, linearity of the ingot produced satisfied required characteristics of the product.

Example 7

Two ingots were produced under conditions similar to those in Example 6 except that the apparatus shown in FIG. 26 was used, hot water at 90° C. was flowing into the first portion 69*a* of top of the cooling member 69 which was divided into three portions, and cold water at 20° C. was flowing into the next second portion 69*b* and the bottom third portion 69*c*. As a result of observation of the surface of the ingot produced, it was confirmed that casting surface was improved more than in Example 6.

Example 8

Two ingots were produced under conditions similar to those in Example 7 except that apparatus shown in FIG. 26 was used, cold water at 20° C. was flowing into the first portion 69*a* of top of the cooling member 69 which was divided into three portions, and hot water at 90° C. was flowing into the next second portion 69*b* and the bottom third portion 69*c*. As a result of observation of surface of the ingot produced, it was confirmed that the casting surface was improved further more than in Examples 6 and 7.

Example 9

Two ingots were produced under conditions similar to those in Example 6 except that the two cooling members 60 were provided as shown in FIG. 24. As a result of observation of surface of the ingot produced, it was confirmed that the casting surface was improved more than in Example 1, in addition, linearity of the ingot was superior.

Example 10

Using the apparatus shown in FIG. 26, the casting surface and warping of the ingot produced were investigated in a case in which the extracting rate of the ingot was increased. As a result, as far as linearity and casting surface condition of the ingot were maintained similar to the ingot produced in Examples 1 to 3, it was confirmed that the extracting rate of the ingot could be increased up to 10%.

Comparative Example 1

Two ingots were produced in a manner similar to that in Example 6 except that the cooling member 60 was not provided. As a result, action of the ingot extracting device slowed down when 30% of total melting time passed, and therefore, the current value of the motor was confirmed. Then, compared to an ordinary case, the value was increased up to the control upper limit. Therefore, halting the extracting device and electron beam, the inside of the apparatus was cooled to room temperature. Observing the situation of the ingots produced, it was confirmed that warping was generated on each surface of the ingots facing each other.

The test conditions and the test results of Examples 6 to 10 and Comparative Example 1 are shown in Table 6. It was confirmed that not only can linearity of the ingot produced be maintained, but also the casting surface of the ingot produced can be improved by arranging cooling member of the present invention between ingots extracted from the molds.

Example 11

Titanium ingots were produced in the following apparatus construction and conditions.

1. Raw material for melting

Titanium sponge (diameter range: 1 to 20 mm)

2. Apparatus construction

1) Hearth (water cooled copper hearth)

2) Mold:

Type 1: mold having a thickness increasing portion shown in FIG. 27A

Upper tapering angle=10 degrees

Figure 27B:
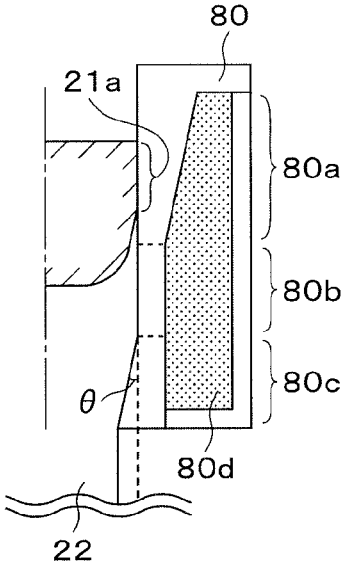
FIG. 27B is a conceptual cross sectional view showing an example in which a taper portion is provided.

Type 2: mold having a thickness increasing portion, a parallel portion, and a tapering portion shown in FIG. 27B Upper tapering angle=10 degrees Lower tapering angle=1 degree Thickness increasing portion length:Parallel portion length:Tapering portion length=50:25:25

Type 3: mold having ceramic lining on inner surface shown in FIG. 30.

Using the mold having a thickness increasing portion of the abovementioned type 1, electron beam melting of titanium sponge was performed and an ingot of 500 kg was produced. The casting surface of the ingot produced was observed visually, and evaluation was performed and the results are shown in Table 7.

Example 12

An ingot of 500 kg was produced in a manner similar to that in Example 11, except that the mold having thickness increasing portion, parallel portion, and lower tapering portion of type 2 was used. The casting surface of the ingot produced was observed visually, and evaluation was performed and the results are shown in Table 7.

Comparative Example 2

An ingot of 500 kg was produced in a manner similar to that in Example 11, except that the mold having a ceramic lining of type 3 was used. After production, as a result of observing the conditions inside the mold, the ceramic lining on the inner surface was removed.

TABLE 6

| | Number of molds | Cooling member | | Extracting rate ratio | Casting surface | Linearity of ingot |
|---|---|---|---|---|---|---|
| | | Number | Temperature distribution | | | |
| Example 6 | 2 | 1 | None | 2.0 | B | B |
| Example 7 | 2 | 1 | Distributed (negative temperature gradient) | 2.0 | A | B |
| Example 8 | 2 | 1 | Distributed (positive temperature gradient) | 2.0 | B | A |
| Example 9 | 2 | 2 | None | 2.0 | B | A |
| Example 10 | 2 | 2 | None | 2.1 | B | B |
| C. Example 1 | 2 | — | — | 1.0 | — | D |

TABLE 7

| | Mold | Casting surface | | |
|---|---|---|---|---|
| | | Top | Middle | Bottom |
| Example 11 | Type 1 | B | B | B |
| Example 12 | Type 2 | A | A | A |
| C. Example 2 | Type 3 | C | D | D |

A: Casting surface is extremely superior
B: Casting surface is superior
C: Casting surface is rough in parts
D: Casting surface is rough over the entire surface

Example 13

The condition of the casting surface of the ingot extracted from the mold and conditions of extracting of ingot were researched in a manner similar to that in Example 12, except that tapering angle of the mold shown in FIG. 27B was varied. The results are shown in Table 8.

It was confirmed that a superior casting surface can be obtained in a case of the tapering angle of 1 to 5 degrees compared to a case in which the tapering angle was 0 degrees; that is, a case of the mold having only the thickness increasing portion and not having the tapering portion shown in FIG. 27A. However, in a case of a tapering angle of 7 degrees, the mold interrupted extraction of the ingot, and thus, the ingot could not be extracted. Therefore, it was confirmed that the preferable tapering angle is in a range of from 1 to 5 degrees in the present invention.

TABLE 8

| Items | Taper angle | | | | |
|---|---|---|---|---|---|
| | 0 | 1 | 3 | 5 | 7 |
| Casting surface | C | A | A | A | — |
| Extracting condition | B | B | B | B | D |

Example 14

Ingots were produced in a manner similar to that in Example 11, except that wall thickness of the thickness increasing portion of the top portion of the mold was varied to double, three times, and four times. The casting surface of each ingot was examined. The results are shown in Table 9. In a case in which wall thickness of the thickness increasing portion is more than double, the casting surface of the ingot was improved; however, notable improvement in the casting surface was not observed in a case in which wall thickness was less than double. Therefore, it was confirmed that the casting surface was improved by making the wall thickness of the thickness increasing portion more than double wall thickness of the parallel portion of the mold wall.

TABLE 9

| | Thickness of thickness increasing portion (—) | | | | |
|---|---|---|---|---|---|
| | 1.0 | 1.5 | 2.0 | 3.0 | 4.0 |
| Casting surface | B | B | A | A | A |

It was confirmed that not only can the linearity of the ingot produced be maintained, but also the casting surface of the ingot produced can be improved by arranging a cooling member of the present invention between ingots extracted from the molds, according to the test conditions and test results of Examples and Comparative Examples described mentioned.

Furthermore, by using a mold having a cooling structure of the present invention, an ingot having a superior casting surface can be produced.

By the present invention, while preferably maintaining properties such as linearity or casting surface of the ingot, in addition, multiple ingots can be efficiently produced at the same time.

EXPLANATION OF REFERENCE NUMERALS

10 . . . Raw material supplying device, 11 . . . raw material conveying device, 12 . . . raw material, 13 . . . hearth, 14,15 . . . electron beam radiating device, 16 . . . mold, 17-19 . . . sluice, 20 . . . molten metal, 21 . . . molten metal pool, 21*a* . . . meniscus portion, 21*b* . . . solid-liquid interface, 22 . . . ingot (square cross section), 23 . . . ingot (circular cross section), 30 . . . ingot extracting jig, 40 . . . melting area, 41 . . . melting area outer case, 50 . . . extracting area, 51 . . . extracting area outer case, 60 . . . cooling member (tabular jacket), 61 . . . cooling member having a square bracket shaped jacket, 62 . . . cooling member having a square shaped jacket, 63,67 . . . cooling member (coil), 64,65 . . . cooling member (triangular pillar (prism) shaped jacket), 66 . . . cooling member (circular), 68 . . . cooling member, 69 . . . cooling member (divided), 69*a*-69*c* . . . first to third portions of divided cooling member, 70 . . . tabular member, 71 . . . tabular member (circular shape), 72 . . . fixing jig, 80-84 . . . mold, 80*a*-84*a* . . . primary cooling portion, 80*b*-84*b* . . . secondary cooling portion, 80*c*-84*c* . . . tapering portion, 80*d*-84*d* . . . (primary) cooling medium, 81*e*,83*e* . . . secondary cooling medium, 85 . . . ceramic, H . . . hot water, L . . . cold water.

The invention claimed is:

1. A melting furnace for producing metal, comprising:

a hearth for holding molten metal formed by melting raw material, a mold in which the molten metal is poured, the mold comprising:

a primary cooling portion in an upper part of the mold, the primary cooling portion having a top and a bottom, and the primary cooling portion configured to provide a first monotonically decreasing temperature from top to bottom, a secondary cooling portion in a lower part of the mold, the secondary cooling portion having a top and bottom, and the secondary cooling portion configured to provide a second monotonically decreasing temperature from top to bottom, different than the first monotonically decreasing temperature, an inflection point of temperature distribution between the primary cooling portion and the secondary cooling portion, and an open bottom beneath the secondary cooling portion, an extracting jig for extracting an ingot cooled and solidified downwardly, which is provided below the mold, a cooling member for cooling the ingot extracted downwardly of the mold, and an outer case for keeping the hearth, the mold, the extracting jig, and the cooling member separated from the air, wherein the ingot has a surface, wherein the cooling member is provided between the outer case and the ingot, while the cooling member extends along the extracting direction of the ingot with a certain gap from the ingot surface, wherein the melting furnace for melting metal is an electron beam furnace, and wherein the primary cooling portion comprises an upper wall of the mold having a thickness increasing portion in which thickness of the upper mold wall increases in an upper direction of the wall, and wherein the secondary cooling portion comprises a lower wall of the mold having a parallel portion in which thickness of the lower mold wall is constant.

2. The melting furnace for producing metal, according to claim 1, wherein a cooling medium flowing in the mold is supplied to the primary cooling portion and the secondary cooling portion, and the temperature of the cooling medium supplied to the primary cooling portion is higher than that of the cooling medium supplied to the secondary cooling portion.

3. The melting furnace for producing metal, according to claim 2, wherein the cooling medium flowing in the mold is serially supplied to the primary cooling portion and the secondary cooling portion, the cooling medium is flowing continuously through a cooling coil wound around the primary cooling portion and the secondary cooling portion, and the cooling coil is wound relatively sparsely around the primary cooling portion and is wound relatively densely around the secondary cooling portion.

4. The melting furnace for producing metal, according to claim 2, wherein the cooling medium flowing outside of the mold consists of a primary cooling medium for cooling the primary cooling portion and a secondary cooling medium for cooling the secondary cooling portion, being provided separately and in parallel, the primary cooling medium flowing in a coil wound around the primary cooling portion, and the secondary cooling medium flowing in a coil would around the secondary cooling portion.

5. The melting furnace for producing metal, according to claim 2, wherein a tapering portion is formed at a lower part of the secondary cooling portion, in which a diameter of an inner surface of the mold decreases along the extracting direction of the ingot.

6. The melting furnace for producing metal, according to claim 1, further comprising metal held within the mold, the metal comprising:

a meniscus portion having a liquid phase;

the ingot located below the meniscus portion; and a liquid-solid interface between the meniscus portion and the ingot, and wherein the liquid phase directly contacts the primary cooling portion of the mold.

* * * * *